US008142972B2

(12) United States Patent
Hotta et al.

(10) Patent No.: US 8,142,972 B2
(45) Date of Patent: Mar. 27, 2012

(54) DEVELOPER FOR REPLENISHMENT AND IMAGE FORMING METHOD

(75) Inventors: Yojiro Hotta, Mishima (JP); Kazuo Terauchi, Numazu (JP); Kunihiko Nakamura, Gotemba (JP); Hiroyuki Fujikawa, Yokohama (JP); Yoshinobu Baba, Yokohama (JP); Takayuki Itakura, Mishima (JP); Hirohide Tanikawa, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 854 days.

(21) Appl. No.: 12/090,270

(22) PCT Filed: Dec. 5, 2006

(86) PCT No.: PCT/JP2006/324634

§ 371 (c)(1),
(2), (4) Date: Apr. 15, 2008

(87) PCT Pub. No.: WO2007/066800

PCT Pub. Date: Jun. 14, 2007

(65) Prior Publication Data

US 2009/0123856 A1 May 14, 2009

(30) Foreign Application Priority Data

Dec. 5, 2005 (JP) ..... 2005-350767

(51) Int. Cl.
*G03G 5/00* (2006.01)

(52) U.S. Cl. ..... 430/111.31; 430/111.1; 430/111.3; 430/111.4

(58) Field of Classification Search ..... 430/111.1, 430/111.3, 111.31, 111.32, 111, 33, 111.4, 430/123.4, 111.33
See application file for complete search history.

(56) References Cited

U.S. PATENT DOCUMENTS

| | | | | |
|---|---|---|---|---|
| 5,573,880 | A | 11/1996 | Mayama et al. | 430/106.6 |
| 5,766,814 | A | 6/1998 | Baba et al. | 430/106.6 |
| 5,998,076 | A * | 12/1999 | Mahabadi et al. | 430/111.32 |
| 6,010,811 | A * | 1/2000 | Baba et al. | 430/110.4 |
| 6,100,000 | A | 8/2000 | Anno et al. | |
| 6,165,663 | A | 12/2000 | Baba et al. | 430/106.6 |

(Continued)

FOREIGN PATENT DOCUMENTS

CN 1384401 A 12/2002

(Continued)

OTHER PUBLICATIONS

International Search Report for the International Application No. PCT/JP2006/324634: Filing Date: May 12, 2006.

(Continued)

*Primary Examiner* — Mark F Huff
*Assistant Examiner* — Stewart Fraser
(74) *Attorney, Agent, or Firm* — Fitzpatrick, Cella, Harper & Scinto

(57) ABSTRACT

Provided is a developer for replenishment capable of forming a high-quality image even upon duration. The developer for replenishment includes at least a toner and a magnetic carrier, and in the developer for replenishment, 1 part by mass of the magnetic carrier is blended with 2 to 50 parts by mass of the toner, and the magnetic carrier contains a ferrite core and a resin component, has a true specific gravity of 2.5 to 4.2 g/cm$^3$, has a 50% particle diameter on a volume basis (D50) of 15 to 70 μm, and has an average circularity of 0.850 to 0.950, the average circularity having a coefficient of variation of 1.0 to 10.0%.

6 Claims, 8 Drawing Sheets

U.S. PATENT DOCUMENTS

| | | | | |
|---|---|---|---|---|
| 6,514,654 | B1 | 2/2003 | Kanbayashi et al. | 430/122 |
| 6,617,088 | B2 | 9/2003 | Iizuka et al. | 430/110.4 |
| 6,936,394 | B2 | 8/2005 | Okado et al. | 430/111.33 |
| 7,244,539 | B2 | 7/2007 | Baba et al. | 430/111.35 |
| 7,279,262 | B2 | 10/2007 | Fujikawa et al. | 430/111.35 |
| 2003/0091922 | A1* | 5/2003 | Okado et al. | 430/111.33 |
| 2003/0104303 | A1* | 6/2003 | Mahabadi et al. | 430/111.32 |
| 2004/0253529 | A1 | 12/2004 | Baba et al. | 430/111.35 |
| 2005/0244737 | A1* | 11/2005 | Baba et al. | 430/120 |
| 2007/0048649 | A1* | 3/2007 | Kobayashi et al. | 430/111.31 |

FOREIGN PATENT DOCUMENTS

| | | | |
|---|---|---|---|
| CN | 1550919 | A | 12/2004 |
| EP | 0431830 | A1 | 6/1991 |
| EP | 1237051 | A2 | 9/2002 |
| EP | 1477864 | A1 | 11/2004 |
| JP | 02-021591 | | 1/1990 |
| JP | 08-292607 | | 11/1996 |
| JP | 2000-003075 | A | 1/2000 |
| JP | 2001-330985 | | 11/2001 |
| JP | 2002-278165 | | 9/2002 |
| JP | 2002-328493 | A | 11/2002 |
| JP | 2003-156887 | A | 5/2003 |
| JP | 2003-328493 | A | 11/2003 |
| JP | 2004-333969 | A | 11/2004 |
| KR | 2002-0070649 | | 9/2002 |
| KR | 2004-0098531 | | 11/2004 |

OTHER PUBLICATIONS

Written Opinion of the International Searching Authority for the International Application No. PCT/JP2006/324634; Filing Date: May 12, 2006.

* cited by examiner

DEVELOPER FOR REPLENISHMENT AND IMAGE FORMING METHOD

TECHNICAL FIELD

The present invention relates to a developer for replenishment which is used in a two-component development method and an image forming method.

BACKGROUND ART

A higher speed and higher reliability have been stringently demanded of a copying device or a printer in recent years. Accordingly, such machine has started to be constituted of elements additionally simple in various respects. As a result, performance demanded of a developer has become additionally sophisticated; an excellent machine will not be established unless an improvement in performance of a developer is achieved.

Of the methods each involving developing an electrostatic charge image with toner, a two-component development method involving the use of a two-component developer obtained by mixing toner with a magnetic carrier has been suitably employed in a full-color copying machine or printer where high image quality is requested. In the two-component development method, the magnetic carrier imparts an appropriate, positive or negative charge amount to the toner by triboelectric charging, and the surface of the magnetic carrier is caused to carry the toner by the electrostatic attraction of the triboelectric charging.

Various properties are demanded of the magnetic carrier and the toner of which the above two-component developer is constituted. Examples of properties particularly important for the magnetic carrier include appropriate chargeability, resistance to an alternating voltage, impact resistance, wear resistance, spent resistance, and developability.

In association with the spread of, for example, a high definition or full-color printer, an additional improvement in image quality is requested even in electrophotography nowadays. However, in the case where an alternating electric field is applied for an improvement in image quality, when the resistivity of a magnetic carrier is low, a latent image electric potential leaks through the magnetic carrier, thereby making it impossible to obtain a good image. Accordingly, the magnetic carrier must have some degree or more of resistivity. Therefore, when the magnetic carrier is conductive, the magnetic carrier is preferably coated with a magnetic carrier coating agent so as to be used as a coated magnetic carrier. A possible approach to bringing the resistivity of a magnetic carrier to an appropriate value involves coating the surface of a core material with an insulative resin. The approach can achieve an improvement in strength of a core and improvements in durability and charging stability simultaneously with the achievement of an appropriate value for the resistivity.

In addition, a capacity for a developer has been reduced in association with a reduction in size of a developing unit, and the speed at which the developer is stirred has increased owing to an increase in speed at which an image is outputted. As a result, a burden on the developer in the developing unit tends to be additionally heavy. The burden on the developer is the impact of magnetic carriers or of a magnetic carrier and toner upon stirring or the impact of a magnetic carrier and a developer layer thickness regulating member for forming a developer layer having a predetermined thickness on a developing sleeve. The impartment of appropriate charge to the toner cannot avoid any one of those impacts, and various proposals have been made to alleviate those impacts. For example, the flowability of a developer is improved by controlling the shape of a magnetic carrier, whereby coat peeling is alleviated (see JP 08-292607 A). However, the control of only the shape of the magnetic carrier in this way does not provide the developer with a completely satisfactory lifetime. Further, a recess of a magnetic carrier core is filled with a conductive additive resin for a reduction in specific gravity and the control of a resistance, whereby an increase in lifetime of a developer and the prevention of the adhesion of a magnetic carrier are achieved (see JP 2002-278165 A). However, when a lower layer component of a magnetic carrier coating layer is conductive as described above, an image failure due to fog occurs owing to the deterioration of durability.

Meanwhile, in order to solve the above problems, a so-called automatic magnetic carrier refresh (ACR) developing device has been disclosed (see, for example, JP 02-21591 B). In the device, simultaneously with the replenishment of a developing unit with toner to be consumed by development, the developing unit is replenished with a new magnetic carrier, and the remaining old magnetic carrier in the developing unit is discharged so that a deteriorated magnetic carrier is gradually replaced. As a result, an increase in lifetime of a developer is achieved.

Further, the specific gravity of a magnetic carrier is reduced so that an external additive is prevented from being embedded in the toner, and an increase in lifetime of a developer is achieved by an ACR development mode (see, for example, JP 2001-330985 A).

In addition, a magnetic carrier core agent having irregularities is filled with a coating resin, whereby a reduction in specific gravity of a magnetic carrier and the smoothness of a fine surface are achieved, and, furthermore, an increase in lifetime of a developer and high image quality are achieved (see, for example, JP 2003-156887 A).

As described above, various proposals have been made to achieve an increase in lifetime of a developer and high image quality. However, the incorporation of a magnetic carrier into a developer for replenishment deteriorates the flowability of the developer, so the replenishment amount of the developer for replenishment to flow from a container for storing the developer for replenishment into a developer tank is not always constant, that is, the amount is uneven. Accordingly, each of the proposals is still susceptible to improvement because each of them provides an image with poor density stability.

A developer for replenishment has been requested, which: can cope with recent, stringent demands for quality on various objects such as a fine line, a small letter, a photograph, and a color copy; and satisfies high image quality, high stability, a high speed, and high durability while coping with a reduction in size of a main body and the simplification of the control of the main body.

DISCLOSURE OF INVENTION

The present invention has been made in light of the foregoing circumstances, and an object of the present invention is to provide a developer for replenishment and an image forming method each enabling the formation of a high-quality image even upon duration. Another object of the present invention is to provide a developer for replenishment and an image forming method each of which is capable of: coping with a reduction in size of a main body and the simplification of the main body; and providing a stable image at all times.

The objects of the present invention are attained by the following.

(1) A developer for replenishment including at least:

a toner; and a magnetic carrier, in which:

1 part by mass of the magnetic carrier is blended with 2 to 50 parts by mass of the toner; and the magnetic carrier (i) contains a ferrite core and a resin component, (ii) has a true specific gravity of 2.5 to 4.2 g/cm$^3$, (iii) has a 50% particle diameter on a volume basis (D50) of 15 to 70 μm, and (iv) has an average circularity of 0.850 to 0.950, the average circularity having a coefficient of variation of 1.0 to 10.0%.

(2) A developer for replenishment according to the above item (1), in which fine particles are dispersed in the resin component, and the fine particles have a primary number average particle diameter of 10 to 500 nm.

(3) A developer for replenishment according to the above item (2), in which the fine particles have a volume specific resistivity of $10^{12}$ Ω·cm or more.

(4) A developer for replenishment according to the above item (2) or (3), in which the fine particles are crosslinked resin fine particles.

(5) A developer for replenishment according to any one of the above items (1) to (4), in which a content of the resin component is 5 to 25 mass % with respect to a mass of the ferrite core.

(6) A developer for replenishment according to any one of the above items (1) to (5), in which the ferrite core is of a porous structure.

(7) An image forming method employing a two-component development method comprising at least:

performing development;

replenishing a developer for replenishment to a developing unit; and discharging at least an excessive magnetic carrier in the developing unit from the developing unit, in which:

the developer for replenishment includes at least a toner and a magnetic carrier, and in the developer for replenishment, 1 part by mass of the magnetic carrier is blended with 2 to 50 parts by mass of the toner; and the magnetic carrier (i) contains a ferrite core and a resin component, (ii) has a true specific gravity of 2.5 to 4.2 g/cm$^3$, (iii) has a 50% particle diameter on a volume basis (D50) of 15 to 70 μm, and (iv) has an average circularity of 0.850 to 0.950, the average circularity having a coefficient of variation of 1.0 to 10.0%.

According to the present invention, there can be provided a developer for replenishment enabling the formation of a high-quality image even upon duration. There can also be provided a developer for replenishment capable of: coping with a reduction in size of a main body and the simplification of the main body; and providing a stable image at all times.

BEST MODE OF CARRYING OUT THE INVENTION

Figure 1:
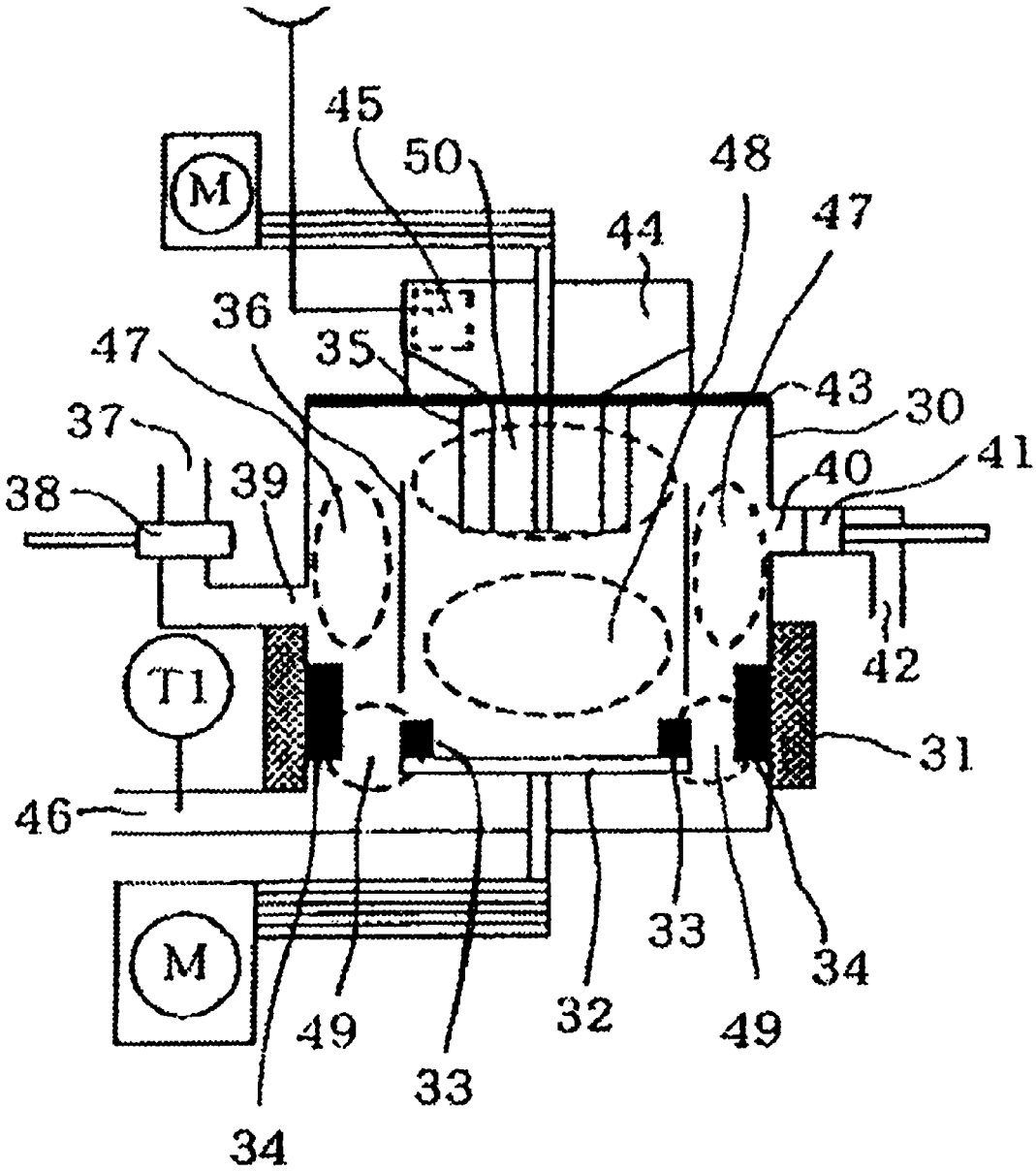
FIG. 1 is a schematic view of a surface modification treatment apparatus.

The inventors of the present invention have made extensive studies with a view to achieving the objects of the present invention. As a result, they have found that a stable, high-quality image can be outputted for a long period of time, in a two-component development method involving performing development while replenishing a developing unit with the developer for replenishment and involving discharging at least an excessive magnetic carrier in the developing unit from the developing unit, by using a developer for replenishment comprising at least:

a toner; and a magnetic carrier, wherein:

1 part by mass of the magnetic carrier is blended with 2 to 50 parts by mass of the toner; and the magnetic carrier (i) contains a ferrite core and a resin component, (ii) has a true specific gravity of 2.5 to 4.2 g/cm$^3$, (iii) has a 50% particle diameter on a volume basis (D50) of 15 to 70 μm, and (iv) has an average circularity of 0.850 to 0.950, the average circularity having a coefficient of variation of 1.0 to 10.0%.

Details about the foregoing will be described below.

The inventors of the present invention have made studies on a magnetic carrier suitable for an improvement in image quality and for a developer for replenishment while paying attention to the spent property and charge imparting ability of each of toner and an external additive and to toner replenishing property. As a result, the inventors have found that a magnetic carrier suitable for them contains a ferrite core and a resin component. In addition, the inventors have found the following concerning the physical properties of the magnetic carrier: as the true specific gravity and particle diameter of the magnetic carrier become smaller, the shape of the carrier becomes rounder, and the distribution of the shape sharpens, the carrier exerts performance more suitable for a developer for replenishment.

The achievement of an improvement in image quality requires compatibility between dense nappings and flowability for faithfully reproducing a latent image. Further, a magnetic carrier having a particle diameter that is small to some degree is needed because toner must be uniformly charged.

Therefore, a magnetic carrier to be used in the present invention has a 50% particle diameter on a volume basis (D50) of preferably 15 to 70 μm, more preferably 25 to 60 μm, or still more preferably 30 to 55 μm. When the 50% particle diameter on a volume basis (D50) of the magnetic carrier is less than 15 μm, there is a tendency that nappings by a magnetic force on a developer carrier for a developer are nonuniform and the homogeneity of a solid image disappears. Further, there is a tendency that the flowability of the developer deteriorates and the rise of charging deteriorates.

On the other hand, when the 50% particle diameter on a volume basis (D50) of the magnetic carrier exceeds 70 μm, a napping of a developer due to magnetism is high and the sweeping unevenness of the developer occurs owing to the napping, so image quality tends to deteriorate.

A magnetic carrier having a 50% particle diameter on a volume basis (D50) satisfying the above range can be produced by optimizing a temperature or an air quantity upon granulation.

When the 50% particle diameter on a volume basis (D50) of the magnetic carrier is small, carrier spent tends to occur owing to an increase in number of points of contact between carrier particles or between the carrier and toner. Further, a reduction in particle diameter of the magnetic carrier deteriorates the flowability of the carrier as a developer, so the rise of charging tends to deteriorate. In addition, when the magnetic carrier has a large abundance of fine particles, the adhesion of the carrier to a latent image-bearing member becomes severe in some cases. As a result, image density unevenness is apt to occur, and, an electrostatic latent image is apt to be disturbed through the carrier. In view of the foregoing, the inventors have made studies while paying attention to the shape of a carrier. As a result, they have found that the above problems can be solved by rounding the shape of the carrier and by sharpening the shape distribution of the carrier.

That is, the magnetic carrier to be used in the present invention has an average circularity of preferably 0.850 to 0.950, more preferably 0.870 to 0.930, or still more preferably 0.880 to 0.920. When the average circularity is smaller than 0.850, desired flowability is hardly obtained, so it becomes difficult to obtain good rise of charging. On the other hand, when the average circularity is larger than 0.950, sufficient charge imparting property cannot be obtained owing to a small surface area of the magnetic carrier. In addition, the shape of the magnetic carrier is close to a true spherical form, so toner and the magnetic carrier undergo point contact, damage to the toner increases, and spending becomes remarkable.

A magnetic carrier having an average circularity satisfying the above range can be produced by, for example, the method of increasing a temperature at calcination of the ferrite core. In addition, the uniform coating of the ferrite core by increasing the addition amount of the resin component is an example of measures for the above improvement in circularity of the magnetic carrier with the resin component to be added.

In addition, the average circularity of the magnetic carrier to be used in the present invention has a coefficient of variation of preferably 1.0 to 10.0%, more preferably 3.0 to 8.0%, or still more preferably 4.0 to 7.0%. The above coefficient of variation is an indicator showing the spread of the average circularity distribution of the magnetic carrier. When the coefficient of variation exceeds 10.0%, carrier adhesion is apt to occur. When the coefficient of variation is less than 1.0%, triboelectric chargeability impartion with toner deteriorates, so toner scattering or fog is apt to occur.

A magnetic carrier having a coefficient of variation of an average circularity satisfying the above range can be produced by coating a ferrite core with a resin component to be added twice so that the core is uniformly coated or by optimizing a sieve upon classification. Also, when a porous structure ferrite core is used, the magnetic carrier can be produced by further coating the surface of the ferrite core after it is filled with a coating resin.

A reduction in particle diameter of the magnetic carrier increases the number of points of contact between the magnetic carrier and toner or between carrier particles, so spending occurs and an image defect such as image roughness is apt to occur after duration owing to the spending. In addition, the inventors have found that, when a toner concentration decreases upon duration, the flowability of a developer deteriorates to such an extent that the developer cannot be stirred, with the result that packing occurs. To cope with the problem, the true specific gravity of the magnetic carrier is set to 2.5 to 4.2 g/cm$^3$.

The true specific gravity of a ferrite core is typically about 5.0 g/cm$^3$, though it varies depending on the core composition of a magnetic carrier. Therefore, for example, it is sufficient to increase the ratio of a resin component to be incorporated in order to obtain a desired true specific gravity by using a ferrite core. In addition, in the case of a ferrite carrier core, grooves on the surface of the ferrite core and porous structure can be obtained by controlling the degree to which the surface of the core particle is grown by sintering upon production of the core or by using a foaming agent or the like.

As described above, the surface shape of a core particle of a ferrite core and an inner structure of a ferrite core can be easily controlled. In addition, a magnetic carrier having a desired true specific gravity can be obtained by adjusting the amounts of the ferrite core and a resin component.

In addition, a generally used ferrite core which has nearly no grooves can be used. However, a ferrite core having a porous structure is preferably used as the ferrite core of the magnetic carrier because of its excellent productivity of particles with a small true specific gravity. Further, the ferrite core is preferable because of the following reason: even when further resin layer is intended, the ferrite core having a porous structure is impregnated with an added resin, so adhesiveness between an added resin and the ferrite core improves. Still further, the carrier having a porous structure is preferable from the point of view that such carrier preferably suppresses carrier adhesion. The detailed reason for which the carrier having a porous structure is preferable cannot be ascertained at this stage. However, it seems that a path suitable for charging current in the carrier may give an effect on such carrier adhesion suppression. The term "ferrite core having a porous structure" as used herein refers to a core having multiple vacancies in itself (The multiple vacancies may be on its surface layer). Examples of a method of producing the core include a method involving lowering a temperature upon calcination to suppress crystal growth and a method involving adding a vacancy forming agent such as a foaming agent to cause a core to generate vacancies.

The above foaming agent is not particularly limited as long as it is a substance which gasifies or generates a gas in association with decomposition at 60 to 180° C. Examples of the above foaming agent include: foaming, azo polymerization initiators such as azobisisobutylonitrile, azobisdimethylvaleronitrile, and azobiscyclohexanecarbonitrile; metal carbonates of sodium, potassium, and the like; ammonium hydrogen carbonate; ammonium carbonate; ammonium nitrate; an azide compound; 4,4'-oxybis(benzenesulfohydrazide); allylbis(sulfohydrazide); and diaminobenzene.

Concerning development mode, an automatic refresh (ACR) development mode must be adopted from the viewpoint of the durability of a developer. According to the mode, a deteriorated magnetic carrier in a developing machine is discharged and replaced with a new magnetic carrier, whereby an increase in lifetime of a developer can be achieved. On the ACR development mode, a magnetic carrier and a toner as the developer for replenishment are replenished at a constant ratio. Accordingly, the magnetic carrier must be uniformly dispersed in the developer for replenishment, so the true specific gravity of the magnetic carrier is 2.5 to 4.2 g/cm$^3$, preferably 3.0 to 4.0 g/cm$^3$, or more preferably 3.0 to 3.8 g/cm$^3$. When the true specific gravity of the magnetic carrier is larger than 4.2 g/cm$^3$, a difference in specific gravity between the magnetic carrier and the toner increases, and the magnetic carrier is apt to segregate in the developer for replenishment, so it becomes difficult to perform stable replenishment with a developer. On the other hand, when the true specific gravity of the magnetic carrier is smaller than 2.5 g/cm$^3$, carrier adhesion is apt to occur.

In addition, the inventors of the present invention have applied a developer for replenishment containing a magnetic carrier the specific gravity of which was reduced by incorporating a resin component into a ferrite core to the ACR development mode. As a result, the inventors of the present invention have found that the dispersibility of the magnetic carrier in a developer for replenishment becomes excellent. A developer for replenishment obtained by incorporating a magnetic carrier into toner is typically inferior to a developer for replenishment containing only toner in flowability, so it is difficult to disperse the magnetic carrier. Further, when the true specific gravity of the magnetic carrier is larger than 4.2 g/cm$^3$, even when the magnetic carrier is uniformly dispersed in the developer for replenishment, the magnetic carrier is apt to segregate toward the inner wall or lower portion of a container for the developer for replenishment in the case where vibration acts during the conveyance of the container for the developer for replenishment.

The inventors of the present invention consider the reason why a magnetic carrier the specific gravity of which was reduced by incorporating a resin component into a ferrite core is excellent in dispersibility in a developer for replenishment under such circumstances to be as described below.

First, the addition of the resin component to the ferrite core uniformizes the shape of the magnetic carrier and improves the flowability of the magnetic carrier. Even when the magnetic carrier is in the developer for replenishment, the flowability of the developer for replenishment does not deteriorate. Accordingly, even when the amount of the developer for replenishment remaining in the container for the developer for replenishment reduces, the dispersibility of the magnetic carrier is excellent, and stable replenishment with the developer can be achieved even in the ACR development mode. Further, the inventors consider that a minute difference in charge imparting property between two arbitrary portions on the surface of the magnetic carrier has an effect. In other words, crystal growth is caused in the ferrite core, so the surface of the core has fine irregularities. The incorporation of a resin into the irregularities does not uniformize the thickness of a resin layer, so a difference in charge imparting property occurs between two arbitrary portions on the surface of the magnetic carrier. As a result, the toner nonuniformly adheres around the magnetic carrier, so the sedimentation or the like of the magnetic carrier is hard to occur in the container for the developer for replenishment. Therefore, the inventors consider that the magnetic carrier dispersed in the developer for replenishment hardly segregates over time.

In the developer for replenishment, 1 part by mass of the magnetic carrier is blended with 2 to 50 parts by mass of the toner. 1 part by mass of the magnetic carrier is preferably blended with 3 to 30 parts by mass of the toner. 1 part by mass of the magnetic carrier is more preferably blended with 4 to 20 parts by mass of the toner. It is not preferable that 1 part by mass of the magnetic carrier be blended with less than 2 parts by mass of the toner because of the following reason: the lifetime of a two-component developer increases, but the amount of the magnetic carrier is large, so, upon removal of the two-component developer in a developing unit, recovery means for recovering the removed, deteriorated two-component developer becomes complicated. Further, the foregoing condition is not preferable because the amount of the toner in a container for storing the developer for replenishment decreases, and the frequency at which the container for storing the developer for replenishment is exchanged increases, so the burden on a user becomes heavy and the cost increases. On the other hand, when 1 part by mass of the magnetic carrier is blended with more than 50 parts by mass of the toner, the toner and the magnetic carrier segregate in the container for storing the developer for replenishment, so charging stability is hardly obtained.

Examples of the ferrite component to be included in the magnetic carrier in the present invention include a ferrite having a magnetic property, which is shown in the following formula (1) or (2).

$$MO.Fe_2O_3 \quad (1)$$

$$M.Fe_2O_4 \quad (2)$$

In the formulae, M represents a tri-, bi-, or monovalent metal ion.

Examples of M include Mg, Al, Si, Ca, Sc, Ti, V, Cr, Mn, Fe, Co, Ni, Cu, Zn, Sr, Y, Zr, Nb, Mo, Sn, Ba, and Li. Each of them can be used alone, or two or more of them can be used together.

Examples of the specific compound for the ferrite having the above-mentioned magnetic property include an iron oxide such as a Zn—Fe ferrite, a Mn—Zn—Fe ferrite, a Ni—Zn—Fe ferrite, a Mn—Mg—Fe ferrite, a Ca—Mn—Fe ferrite, a Ca—Mg—Fe ferrite, a Li—Fe ferrite, and a Cu—Zn—Fe ferrite. For a production method of a ferrite core to be used in the present invention, any known method thereof may be employed. There can be exemplified a method which involves: mixing a ground ferrite composition with a binder, water, a dispersant, an organic solvent, and the like; forming the resultant into particles by a spray dryer method or a fluidized granulation method; baking the particles in a rotary kiln or a batch-type kiln at temperatures in the range of 700 to 1,400° C., or preferably 800 to 1,200° C.; and classifying the resultant particles by sieving and controlling the particle degree distribution, thereby providing core material particles (i.e., core particles) for the magnetic carrier. Further, surface properties of the core can be controlled by, for example, controlling the oxygen partial pressure in the baking step, or subjecting the particle surface after the baking to an additional oxidization or reduction treatment.

A resin component to be contained in the above-mentioned magnetic carrier is not particularly limited. Specific examples of the resin component include an acrylic resin such as a polystyrene or a styrene-acrylic copolymer, vinyl chloride, vinyl acetate, a polyvinylidene fluoride resin, a fluorocarbon resin, a perfluorocarbon resin, a solvent-soluble perfluorocarbon resin, a polyvinyl alcohol, a polyvinyl acetal, a polyvinyl pyrolidone, a petroleum resin, cellulose, a cellulose derivative, a novolac resin, a low-molecular-weight polyethylene, a saturated alkyl polyester resin, an aromatic polyester resin, a polyamide resin, a polyacetal resin, a polycarbonate resin, a polyethersulfone resin, a polysulfone resin, a polyphenylene sulfide resin, a polyether ketone resin, a phenol resin, a modified phenol resin, a maleic resin, an alkyd resin, an epoxy resin, an acrylic resin, an unsaturated polyester resin obtained by polymerization of maleic anhydride, terephthalic acid, and a polyalcohol, a urea resin, a melamine resin, a urea-melamine resin, a xylene resin, a toluene resin, a guanamine resin, a melamine-guanamine resin, an acetoguanamine resin, a glyptal resin, a furan resin, a silicone resin, a polyimide resin, a polyamide-imide resin, a polyetherimide resin, and a polyurethane resin.

Resins obtained by modifying those resins may also be used. Of those, a fluorine-containing resin such as a polyvinylidene fluoride resin, a fluorocarbon resin, a perfluorocarbon resin, or a solvent-soluble perfluorocarbon resin, an acrylic-modified silicone resin, or a silicone resin has a high releasability, so is preferable.

Specific examples of the silicone resin may include any conventionally known silicone resin, such as a straight silicone resin only composed of organosiloxane bonds, which is shown in the following formula, and a silicone resin which is modified by an alkyd, a polyester, an epoxy, a urethane, or the like.

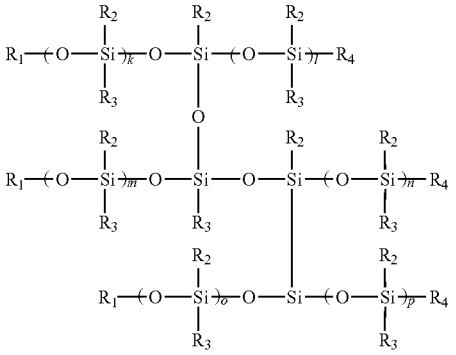

In the formula, $R_1$ represents a hydrogen atom, an alkyl group having 1 to 4 carbon atoms, or a phenyl group, $R_2$ and $R_3$ each represent a hydrogen atom, an alkyl group having 1 to 4 carbon atoms, an alkoxy group having 1 to 4 carbon atoms, a phenyl group, an alkenyl group having 2 to 4 carbon atoms, an alkenyloxy group having 2 to 4 carbon atoms, a hydroxy group, a carboxyl group, an ethyleneoxide group, a glycidyl group, or a group represented by the following formula.

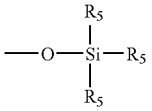

In the formulae, $R_4$ and $R_5$ each represent a hydroxy group, a carboxyl group, an alkyl group having 1 to 4 carbon atoms, an alkoxy group having 1 to 4 carbon atoms, an alkenyl group having 2 to 4 carbon atoms, an alkenyloxy group having 2 to 4 carbon atoms, a phenyl group, or a phenoxy group, and k, l, m, n, o, and p each represent an integer of 1 or more.

Each of those substituents may have no substitution, or may have a substituent such as an amino group, a hydroxy group, a carboxyl group, a mercapto group, an alkyl group, a phenyl group, an ethyleneoxide group, or a halogen atom. Examples of a commercially available straight silicone resin include KR271, KR255, and KR152 (all manufactured by Shin-Etsu Chemical Co., Ltd.), and SR2400 and SR2405 (both manufactured by Dow Corning Toray Co., Ltd.). Examples of the modified silicone resin include KR206 (alkyd modified), KR5208 (acrylic modified), ES1010N (epoxy modified), and KR305 (urethane modified) (all manufactured by Shin-Etsu Chemical Co., Ltd.), and SR2115 (epoxy modified) and SR2110 (alkyd modified) (both manufactured by Dow Corning Toray Co., Ltd.).

For the above-mentioned resin component, a silicone resin is preferably used in view of adhesiveness with a ferrite core, prevention of a spent, and the strength of film. The silicone resin may be used alone, and preferably used with a coupling agent. Further, plural kinds of resins are preferably used together in view of an improvement in the adhesive strength of the resin.

Examples of the coupling agent to be used suitably include a silane coupling agent, a titanium coupling agent, and an aluminum coupling agent. Examples of the silane coupling agent include γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)-γ-aminopropyltrimethoxysilane hydrochloride, γ-glycidoxypropyltrimethoxysilane, γ-mercaptopropyltrimethoxysilane, methyltrimethoxysilane, methyltriethoxysilane, vinyltriacetoxysilane, γ-chloropropyltrimethoxysilane, hexamethyldisilazane, γ-anilinopropyltrimethoxysilane, vinyltrimethoxysilane, octadecyldimethyl[3-(trimethoxysilyl)propyl]ammonium chloride, γ-chloropropylmethyldimethoxysilane, methyltrichlorosilane, dimethyldichlorosilane, trimethylchlorosilane (all manufactured by Toray Silicone Co., Ltd.), allyltriethoxysilane, 3-aminopropylmethyldiethoxysilane, 3-aminopropyltrimethoxysilane, dimethyldiethoxysilane, and 1,3-divinyltetramethyldisilazane, methacryloxyethyldimethyl(3-trimethoxysilylpropyl)ammonium chloride (all manufactured by CHISSO CORPORATION). Of those, aminosilane is preferable.

The use of aminosilane described above as the above coupling agent can introduce an amino group having positive chargeability to the surface of the magnetic carrier and can favorably impart negative charging property to the toner. Further, the presence of an amino group activates both a lipophilic treatment agent with which a metal compound is preferably treated and the silicone resin, so adhesiveness between the silicone resin and the ferrite core is additionally improved, and, at the same time, the curing of the resin is accelerated. As a result, an additionally rigid resin layer can be formed.

The content of the above resin component is preferably 5.0 to 25.0 mass % with respect to the mass of the magnetic carrier which contains ferrite core and resin core in order that the true specific gravity of the magnetic carrier may have a desired value. The content is more preferably 7.0 to 20.0 mass %, or still more preferably 9.0 to 15.0 mass %.

The above resin is preferably being filled in the ferrite core having porous structure by being impregnated in the ferrite core. It is further preferable that the resin is impregnated in the ferrite core and the surface of the ferrite core is coated with the above resin at the same time. In addition, a coating layer for the surface of the magnetic carrier may be present in addition to the above resin layer. In this case, the resin layer and the coating layer may be made of the same component, or may be made of different components. Still further, the surface of the ferrite core is preferably coated with the resin component.

The above magnetic carrier preferably has a magnetization ($\sigma_{240}$) of 30 to 90 $Am^2/kg$, a residual magnetization of 2 to 20 $Am^2/kg$, and a coercive force of 0.4 to 4.8 kA/m in an applied magnetic field of 240 kA/m. The magnetization ($\sigma_{240}$) is more preferably in the range of 58 to 78 $Am^2/kg$.

When the above magnetization ($\sigma_{240}$) exceeds 90 $Am^2/kg$, a tendency that a napping on a magnetic brush hardens and an impact on a developer regulating blade or the like is apt to be large upon stirring is observed.

In addition, when the above magnetization ($\sigma_{240}$) is less than 30 $Am^2/kg$, the scattering of the magnetic carrier is apt to occur. In addition, when the residual magnetization or the coercive force described above deviates from the above value range, the conveying property of the developer in a developing unit is apt to be unstable, so durability tends to be poor. In addition, the above residual magnetization is not preferably large because the segregation of the magnetic carrier occurs in the developer for replenishment owing to stirring in a replenishment container, so discharging property becomes unstable.

When the above residual magnetization is 20 $Am^2/kg$ or more or when the above coercive force is 4.8 kA/m or more, the flowability of the developer is apt to deteriorate. When the residual magnetization is less than 2 $Am^2/kg$ and the coercive force is less than 0.4 kA/m, the flowability of the developer is so high that toner which is not sufficiently charged may be produced.

In the magnetic carrier, fine particles are preferably dispersed in the resin component. The incorporation of the fine particles into the above resin component can result in the formation of fine surface irregularities, which do not affect an average circularity, on the surface of the magnetic carrier. The irregularities can efficiently bring the toner and the magnetic carrier into contact with each other, and can suppress the peeling of the resin layer from the magnetic carrier.

The fine particles to be dispersed in the resin component have a primary number average particle diameter of preferably 10 to 500 nm, or more preferably 50 to 200 nm. The above fine particles exert an improving effect on the rise of charging of the toner because they form the fine irregularities present on the surface of the carrier upon coating of the carrier with the resin component. In addition, the presence of the irregularities improves spending resistance and enables durability to be maintained.

The above fine particles are preferably particles each having a volume specific resistivity of $10^{12}$ Ω·cm or more. In this case, the charge imparting property of the surface of the magnetic carrier is not affected by an environment and is maintained, and the developer shows a reduced fluctuation with the environment.

Particles having a primary number average particle diameter in the above range can be produced by optimizing a pulverization pressure or time in the case of using pulverization method. The particles can be produced by optimizing a polymerization temperature or time in the case of using polymerizing method.

Examples of the fine particles include resin fine particles composed of a polymer obtained by polymerizing alumina or a polymerizable monomer alone or by copolymerizing them. Examples of the polymerizable monomer include: a styrene monomer such as styrene, o-methylstyrene, m-methylstyrene, p-methoxystyrene, p-ethylstyrene, α-methylstyrene, or p-tertiary-butylstyrene; acrylic acid and acrylates such as methyl acrylate, ethyl acrylate, n-butyl acrylate, n-propyl acrylate, isobutyl acrylate, octyl acrylate, dodecyl acrylate, 2-ethylhexyl acrylate, stearyl acrylate, 2-chloroethyl acrylate, and phenyl acrylate; methacrylic acid and methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminomethyl methacrylate, and diethylaminoethyl methacrylate; acrylates or methacrylates such as 2-hydroxyethyl acrylate or 2-hydroxyethyl methacrylate; acrylate or methacrylate derivatives such as acrylonitrile, methacrylonitrile, and acrylamide; and a vinyl derivative, specifically, for example, alkyl vinyl ethers such as methyl vinyl ether, ethyl vinyl ether, propyl vinyl ether, n-butyl ether, or isobutyl ether, β-chloroethylvinylether, phenylvinylether, p-methylphenylether, p-chlorophenylether, p-bromophenylether, p-nitrophenylvinylether, p-methoxyphenylvinylether, 2-vinylpyridine, 3-vinylpyridine, 4-vinylpyridine, N-vinylpyrrolidone, 2-vinylimidazole, N-methyl-2-vinylimidazole, N-vinylimidazole, or butadiene. Of those, the fine particles preferably comprise crosslinked resin fine particles which have a crosslinked structure, particularly, a crosslinked polymethylmethacrylate (PMMA) particle or a melamine resin particle which are preferable.

Examples of a method of granulating the above resin fine particles include: a method involving subjecting the above polymer to a pulverization treatment; and a polymerization method such as emulsion polymerization, soap-free emulsion polymerization, suspension polymerization, or dispersion polymerization. The addition amount of the above particles is preferably 0.1 to 50 mass % with respect to the resin component contained in the magnetic carrier. The amount is more preferably 1.0 to 45 mass % because an additionally good effect can be exerted.

In addition, a general method of having the resin component on the ferrite core involves: diluting the resin component with a solvent; and adding the resultant to the ferrite core. The solvent used here is not limited as long as it can dissolve each resin component. In the case of a resin soluble in an organic solvent, examples of the organic solvent include toluene, xylene, butyl cellosolve acetate, methyl ethyl ketone, methyl isobutyl ketone, and methanol. In the case of a water-soluble resin component or an emulsion type resin component, it is sufficient to use water. An example of a method of adding the resin component diluted with the solvent to the ferrite core is a method involving: impregnating the core with the resin component by an application method such as an immersion method, a spray method, a brush coating method, a fluid bed, or a kneading method; and volatilizing the solvent after the impregnation. It should be noted that the surface of the magnetic carrier core can be filled with the powder of the resin component by a dry method instead of such wet method using a solvent. In addition, the resin component can be added twice upon formation of the resin layer. The addition of the resin component twice is preferably used because adhesiveness between the resin layer and the magnetic carrier core is additionally improved and a uniform resin layer can be obtained on the surface of the magnetic carrier core. A method of forming the resin layer upon application of the resin component twice may be a method exemplified in the above addition method. When the resin component is added twice, the same method may be used twice, or different methods may be used.

In addition, the above ferrite core may have a coating layer in addition to the resin layer. The coating layer is formed as a new layer after the resin layer has been formed on the ferrite core. The coating layer can adjust charging and can prevent the deterioration of durability. A general method of forming the coating layer involves: diluting a coating component with a solvent; and adding the resultant. The solvent used here is not limited as long as it can dissolve each coating component. In the case of a component soluble in an organic solvent, examples of the organic solvent include toluene, xylene, butyl cellosolve acetate, methyl ethyl ketone, methyl isobutyl ketone, and methanol. In the case of a water-soluble coating component or an emulsion type coating component, it is sufficient to use water. An example of a method of adding the coating component diluted with the solvent is a method involving: applying the coating component by an application method such as an immersion method, a spray method, a brush coating method, a fluid bed, or a kneading method; and volatilizing the solvent after the application. It should be noted that the surface of core particle can be coated with the powder of the coating component by a dry method instead of such wet method using a solvent.

After the above resin component is carried on the ferrite core, and then the resin component is baked on the particle, a device according to a baking mode chosen from an external heating mode and an internal heating mode may be used. Examples of the above device include: a fixed type or fluid type electric furnace; a rotary type electric furnace; a burner furnace; and a baking device using a microwave. A baking temperature, which varies depending on a resin component to be used, must be equal to or higher than the melting point or glass transition point of the resin component. In addition, in the case of a thermosetting resin or a condensation resin, the baking temperature must be increased up to the temperature at which the curing of the resin sufficiently progresses.

Thus, the resin component is carried on the ferrite core, and the resin component has been baked on the surface as described above, the resultant is cooled, shredded, and subjected to grain size adjustment, whereby a magnetic carrier coated with a resin is obtained.

Fine particles such as the above resin fine particles are preferably present on the surface of the magnetic carrier. A method involving, for example, dispersing the fine particles in a solvent upon addition of the resin component to disperse the particles in the magnetic carrier core is employed for causing the fine particles to be present on the surface of the magnetic carrier. In this case, a solvent in which the above resin particles do not swell is preferably selected as the solvent in which the fine particles are dispersed.

A toner to be used in the present invention is noted below. Generally, the toner contains binder resin and colorant. The toner may further contain other agents such as releasing agent, charge controlling agent, as needed.

Examples of the binder resin used in combination include: a polyester; polystyrene; a polymer compound obtained from a styrene derivative such as poly-p-chlorostyrene or polyvinyltoluene; a styrene copolymer such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-α-methyl chloromethacrylate copolymer, a styrene-acrylonitrile copolymer, a styrene-vinylmethylketone copolymer, a styrene-butadiene copolymer, a styrene-isoprene copolymer, or a styrene-acrylonitrile-indene copolymer; a polyvinyl chloride; a phenol resin; a modified phenol resin; a maleic resin; an acrylic resin; a methacryl resin; polyvinyl acetate; a silicone resin; an aliphatic polyalcohol; an aliphatic dicarboxylic acid and an aromatic dicarboxylic acid; a polyester resin having as a structure unit a monomer selected from aromatic dialcohols and diphenols; a polyurethane resin; a polyamide resin; polyvinylbutyral; a terpene resin; a coumarone-indene resin; a petroleum resin; and a hybrid resin having a polyester unit and a vinyl-based polymer unit.

Examples of the releasing agent include the following:

an aliphatic hydrocarbon wax such as a low-molecular-weight polyethylene wax, a low-molecular-weight polypropylene wax, a microcrystalline wax, a paraffin wax, or a Fischer-Tropsch wax; an oxide of the aliphatic hydrocarbon-based wax such as an oxidized polyethylene wax; a block copolymer of the aliphatic hydrocarbon wax; a wax mainly composed of an fatty acid ester, such as a carnauba wax, a montanate wax, a candelilla wax, a rice wax, ozokerite, or a bees wax; and a wax obtained by deoxidizing part of or whole fatty acid ester, such as a deoxidized carnauba wax.

Examples of the releasing agent further include: a saturated linear fatty acid such as palmitic acid, stearic acid, or montanic acid; an unsaturated fatty acid such as brassidic acid, eleostearic acid, or valinaric acid; a saturated alcohol such as stearyl alcohol, aralkyl alcohol, behenyl alcohol, carnaubyl alcohol, ceryl alcohol, or mericyl alcohol; a polyalcohol such as sorbitol; a fatty acid amide such as amide linoleate, amide oleate, or amide laurate; a saturated fatty acid bisamide such as methylenebis amide stearate, ethylenebis amide caprate, ethylenebis amide laurate, or hexamethylenebis amide stearate; an unsaturated fatty acid amide such as ethylenebis amide oleate, hexamethylenebis amide oleate, N,N'-dioleyl amide adipate, or N,N'-dioleyl amide sebacate; an aromatic bisamide such as m-xylenebis amide stearate or N,N'-distearyl amide isophthalate; a fatty acid metal salt (which is generally referred to as "metal soap") such as calcium stearate, calcium laurate, zinc stearate, or magnesium stearate; a graft wax obtained by subjecting an aliphatic hydrocarbon wax to graft reaction with a vinyl monomer such as styrene or acrylic acid; a partial esterified product obtained from a reaction between a fatty acid and a polyalcohol, such as monoglyceride behenate; and a methylester compound having a hydroxyl group, which is obtained by hydrogenating a vegetable oil.

A releasing agent to be particularly preferably used is a paraffin wax which has a short molecular chains, little steric hindrance, and excellent mobility.

A molecular weight distribution of the releasing agent which is measured by means of gel permeation chromatography (GPC) has a main peak preferably in the molecular weight range of 350 to 2,400, and more preferably in the molecular weight range of 400 to 2,000. The use of a releasing agent having such a molecular weight distribution is effective in imparting preferable heat characteristics to the toner.

The releasing agent is preferably contained in the binder resin in an amount of 1 to 10 parts by mass, more preferably 2 to 8 parts by mass with respect to 100 parts by mass of the binder resin. If the addition amount of the releasing agent is less than 1 part by mass, it is not sufficient for exerting releasability when being emerged on the surface of the toner upon melting, so considerable amounts of heat and pressure are required. In contrast, if the addition amount of the releasing agent exceeds 10 parts by mass, the amount of the releasing agent in the toner is so large that clarity or charging properties may deteriorate.

The colorant may employ the following pigment and/or dye.

Examples of the coloring pigments for magenta include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, or 209, C.I. Pigment Violet Red 19, and C.I. Vat Red 1, 2, 10, 13, 15, 23, 29, or 35.

Examples of the dye for magenta include an oil soluble dye such as C.I. Solvent Red 1, 3, 8, 23, 24, 25, 27, 30, 49, 81, 82, 83, 84, 100, 109, or 121, C.I. Disperse Red 9, C.I. Solvent Violet Red 8, 13, 14, 21, or 27, and C.I. Disperse Violet Red 1, and a basic dye such as C.I. Basic Red 1, 2, 9, 12, 13, 14, 15, 17, 18, 22, 23, 24, 27, 29, 32, 34, 35, 36, 37, 38, 39, or 40, and C.I. Basic Violet Red 1, 3, 7, 10, 14, 15, 21, 25, 26, 27, or 28.

Each of those pigments or dyes may be used alone. However, the pigment and dye may preferably be used together to increase the clarity of the resultant, in view of image quality of a full-color image.

Examples of the coloring pigments for cyan include C.I. Pigment Blue 2, 3, 15, 16, or 17, C.I. Vat Blue 6, C.I. Acid Blue 45, and a copper phthalocyanine pigment obtained by substituting 1 to 5 phthalimidemethyl groups for a phthalocyanine skeleton.

Examples of the coloring pigments for yellow include C.I. Pigment Yellow 1, 2, 3, 4, 5, 6, 7, 10, 11, 12, 13, 14, 15, 16, 17, 23, 65, 73, 74, 83, 155, or 180, and C.I. Vat yellow 1, 3, or 20.

Note that the usage amount of the colorant is preferably 0.1 to 60 parts by mass, more preferably 0.5 to 50 parts by mass with respect to 100 parts by mass of the binder resin.

An organometallic compound can be incorporated as a charge control agent into the toner as required before the use of the toner. The above organometallic compound is preferably the compound of a metal with an aromatic carboxylic acid derivative selected from an aromatic oxycarboxylic acid and an aromatic alkoxycarboxylic acid. The above metal is preferably a metal atom which is divalent or more. Examples of a divalent metal include $Mg^{2+}$, $Ca^{2+}$, $Sr^{2+}$, $Fe^{2+}$, $Co^{2+}$, $Ni^{2+}$, and $Cu^{2+}$. Of those, $Ca^{2+}$, $Mg^{2+}$, and $Sr^{2+}$ are preferable. Examples of a metal which is trivalent or more include $Al^{3+}$, $Fe^{3+}$, and $Ni^{3+}$. Of those, $Al^{3+}$ is preferable. Of the above metals, $Al^{3+}$ is particularly preferable. Specific metal compounds are exemplified below.

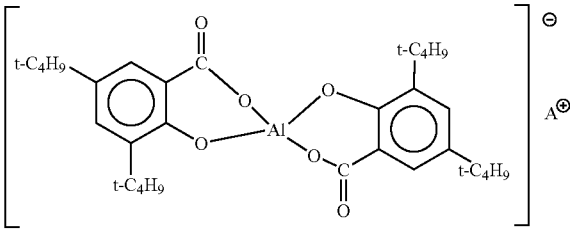

where A represents hydrogen, an alkali metal, or an alkali earth metal.

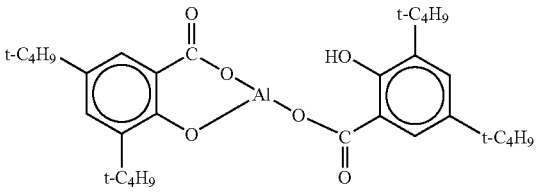

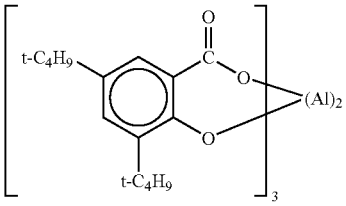

-continued

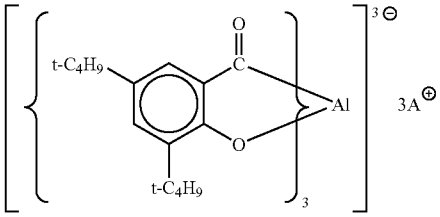

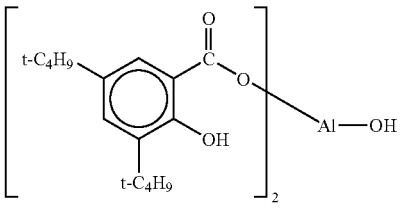

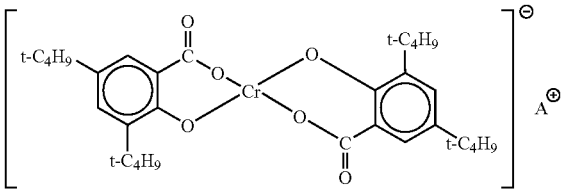

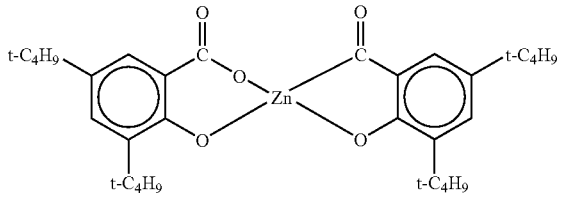

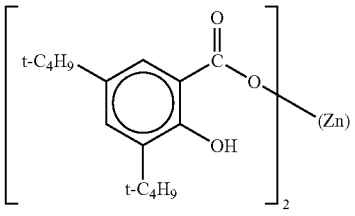

Of those metal compounds, an aluminum compound of di-tert-butylsalicylic acid is particularly preferable.

The addition amount of the above charge control agent is 0.3 to 10 parts by mass, or preferably 0.5 to 7 parts by mass with respect to 100 parts by mass of the binder resin. When the addition amount of the above charge control agent is less than 0.3 part by mass, an improvement effect of the rise of charging cannot be obtained. When the amount is more than 10 parts by mass, a fluctuation with the environment increases.

Examples of a method of producing toner particles include: a pulverization method involving melting and kneading a binder resin, a colorant, and any other internal additive, cooling the kneaded product, pulverizing the cooled product, and classifying the pulverized product; a method involving directly producing toner particles by employing a suspension polymerization method; a dispersion polymerization method involving directly producing toner particles by using an aqueous organic solvent in which a monomer is soluble and a polymer to be obtained is insoluble; a method involving producing toner particles by employing an emulsion polymerization method typified by a soap-free polymerization method involving performing direct polymerization in the presence of a water-soluble, polar polymerization initiator to produce toner particles; and a dissolution suspension granulation method.

A method of producing toner particles by the above pulverization method will be detailed.

In a raw material mixing step, predetermined amounts of a binder resin, a colorant, a release agent, and the like as toner internal additives are weighed, and they are blended and mixed with one another. Examples of a mixing device include a doublecone mixer, a V type mixer, a drum type mixer, a Super mixer, a Henschel mixer, and a Nauta mixer.

The raw materials for toner particles blended and mixed with one another in the foregoing are melted and kneaded so that binder resins are melted. Then, a colorant and the like are dispersed in the melt. In the melting and kneading step, a batch type kneader such as a pressure kneader or a Banbury mixer, or a continuous kneader can be used. A uniaxial or biaxial extruder has gone mainstream in recent years because of its superiority such as an ability to produce toner particles continuously. Examples of a uniaxial or biaxial extruder generally used include: a KTK biaxial extruder manufactured by Kobe Steels, Ltd.; a TEM biaxial extruder manufactured by Toshiba Machine Co., Ltd.; a biaxial extruder manufactured by KCK Engineering Co., Ltd.; and a co-kneader manufactured by Buss.

A colored resin composition obtained by melting and kneading the raw materials for toner particles is rolled with a twin roll or the like after the melting and kneading, and is cooled through a cooling step of cooling the rolled produced with water or the like.

Next, the cooled product of the colored resin composition obtained in the foregoing is generally pulverized into particles each having a desired particle diameter in a pulverizing step. In the pulverizing step, the cooled product is coarsely pulverized with a crusher, a hammer mill, a feather mill, or the like, and the coarsely pulverized product is pulverized with a Kryptron system manufactured by Kawasaki Heavy Industries, a Super rotor manufactured by Nisshin Engineering Inc., or the like. After that, the pulverized product is classified as required by using a screen classifier of a classifier such as an Elbow jet according to an inertial classification mode (manufactured by Nittetsu Mining Co., Ltd.) or a Turboplex according to a centrifugal classification mode (manufactured by Hosokawa Micron Corporation), whereby a classified product having a weight average particle diameter of 3 to 11 μm is obtained.

In addition, a spheroidization treatment can be preformed as surface modification in a surface modification step as required. The pulverized product can be subjected to the above spheroidization treatment by using, for example, a Hybridization System manufactured by NARA MACHINERY CO., LTD., or a Mechanofusion System manufactured by Hosokawa Micron Corporation to provide a classified product.

An example of a preferable method of producing the toner involves: pulverizing raw materials with an air-jet pulverizer without using mechanical pulverization in a pulverizing step; and producing a classified product having a weight average particle diameter of 3 to 11 μm by using an apparatus shown in FIG. 1 that performs classification and a surface modification treatment using a mechanical impact force at the same time.

A batch type surface modification apparatus shown in FIG. 1 includes: a cylindrical main body casing 30; a top plate 43 placed on the upper portion of the main body casing so as to be openable and closable; a fine powder discharge portion 44 having a fine powder discharge casing and a fine powder discharge pipe; a cooling jacket 31 through which coolant or antifreeze can pass; a dispersion rotor 32 as surface modification means, the dispersion rotor 32 being present in the main body casing 30 and attached to a central rotation axis, the dispersion rotor 32 having multiple square disks 33 on its upper surface, and the dispersion rotor 32 being a disk-like rotator rotating in a predetermined direction at a high speed; a liner 34 fixedly arranged on the periphery of the dispersion rotor 32 with a predetermined interval between the liner and the rotor, the liner 34 being provided with a large number of grooves on its surface opposed to the dispersion rotor 32; a classification rotor 35 for continuously removing a fine powder and an ultra-fine powder each having a particle diameter equal to or smaller than a predetermined particle diameter in a finely pulverized product; a cold air introduction port 46 for introducing cold air into the main body casing 30; an input pipe which is formed on the side surface of the main body casing 30 for introducing the finely pulverized product (raw material) and which has a raw material input port 37 and a raw material supply port 39; a product discharge pipe having a product discharge port 40 for discharging toner particles after a surface modification treatment to the outside of the main body casing 30 and a product extraction port 42; an openable/closable raw material supply valve 38 placed between the raw material input port 37 and the raw material supply port 39 in order that a surface modification time may be freely adjusted; and a product discharge valve 41 placed between the product discharge port 40 and the product extraction port 42.

A method of producing toner particles by the above dissolution suspension granulation method will be detailed.

A monomer is polymerized in advance, and a polymerization temperature and a polymerization time are adjusted in order that a desired molecular weight distribution may be obtained. Magnetic metal fine particles, a release agent, a colorant, a polymerizable monomer, and a polymerization initiator are added to the resultant polymer. After the resultant mixture has been suspended by applying a mechanical shear force in the presence of an inorganic or organic dispersant, thermal energy is applied while stirring shear is applied, whereby toner particles are obtained.

Particles each having a circle-equivalent diameter of 2.0 μm or more in the toner have an average circularity of preferably 0.930 to 0.985, or more preferably 0.940 to 0.980.

In addition, the toner preferably has a weight average particle diameter of 4.0 to 9.0 μm, and preferably contains 20 to 70 number % of toner particles each having a particle diameter of 5.0 μm or less, 3 to 40 number % of toner particles each having a particle diameter of 4.0 μm or less, 3 to 60 vol % of toner particles each having a particle diameter of 8.0 μm or more, and 15 vol % or less of toner particles each having a particle diameter of 10.0 μm or more.

An additive to the toner is preferably a flowability improver.

For example, after pulverizing and classifying steps, the resultant toner particles are mixed with a flowability improver or the like by using a mixer such as a Henschel mixer, whereby toner with improved flowability can be obtained.

Any flowability improver can be used as the above flowability improver as long as the addition of the flowability improver to toner particles can improve flowability as compared to flowability before the addition. Examples of the flowability improver include: a vinylidene fluoride fine powder; a fluorine resin powder such as a polytetrafluoroethylene fine powder; a titanium oxide fine powder; an alumina fine powder; fine powdered silica such as silica obtained through a wet process or silica obtained through a dry process; and treated silica obtained by treating the surface of the above silica with a silane compound, an organic silicon compound, a titanium coupling agent, silicone oil, or the like.

The silica obtained through a dry process described above is a fine powder produced through the vapor phase oxidation of a silicon halide compound, and is called dry process silica or fumed silica. The dry process silica or fumed silica is produced by means of a conventionally known technique. For example, the production utilizes a thermal decomposition oxidation reaction in the oxyhydrogen flame of a silicon tetrachloride gas, and a reaction formula that provides a basis for the reaction is represented by the following formula (3):

$$SiCl_4+2H_2+O_2 \rightarrow SiO_2+4HCl. \quad (3)$$

A composite fine powder of silica and any other metal oxide can also be obtained by using a silicon halide compound with any other metal halide compound such as aluminum chloride or titanium chloride in the production step, and silica comprehends the composite fine powder as well. A silica fine powder having an average primary particle diameter in the range of preferably 0.001 to 2 μm, or particularly preferably 0.002 to 0.2 μm is desirably used.

Titanium oxide fine particles obtained by: a sulfate method; a chlorine method; and a low-temperature oxidation method (thermal decomposition or hydrolysis) for volatile titanium compounds such as titanium alkoxide, titanium halide, and titanium acetylacetonate are used as the above titanium oxide fine powder. Any one of the crystal systems including anatase, rutile, a mixed crystal of them, and amorphous can be used.

An alumina fine powder obtained by: a Bayer process; an improved Bayer process; an ethylene chlorohydrin method; a submerged spark discharge method; an organic aluminum hydrolysis method; an aluminum alum thermal decomposition method; an ammonium aluminum carbonate thermal decomposition method; or a flame decomposition method for aluminum chloride is used as the above alumina fine powder. Any one of the crystal systems including α, β, γ, δ, ζ, η, θ, κ, χ, and ρ types, a mixed crystal of them, and amorphous is used. Of those, the α, δ, γ, and θ types, the mixed crystal, and amorphous are preferably used.

Flowability improver, which is obtained by being chemically or physically treated on the surface with an organic silicon compound or the like, which involves reaction or physical absorption with an inorganic fine powder, is preferably used. Examples of the organic silicon compound include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylsilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per a molecule and containing a hydroxyl group bonded to each Si at the unit in the terminal. Any one kind of them may be used alone, or two or more kinds of them may be used as a mixture.

In addition, the dry process silica described above treated with a coupling agent having an amino group or silicone oil may be used as the flowability improver.

The flowability improver provides good results when it has a specific surface area according to nitrogen adsorption measured by a BET method of 30 $m^2/g$ or more, or preferably 50 $m^2/g$ or more. The content of the above flowability improver is preferably 0.01 to 8 parts by mass, or more preferably 0.1 to 4 parts by mass with respect to 100 parts by mass of the toner particles.

When a developer for replenishment is prepared in the present invention, predetermined amounts of toner and a magnetic carrier are weighed, and they are mixed in a mixer. Examples of a mixing device include a doublecone mixer, a V type mixer, a drum type mixer, a Super mixer, a Henschel mixer, and a Nauta mixer. Of those, the V type mixer is preferable in consideration of the dispersibility of the magnetic carrier and the rise of charging of the toner.

A developer for replenishment of the present invention can be used in any image forming apparatus which needs replenishment of a developer which contains magnetic carrier.

Figure 3:
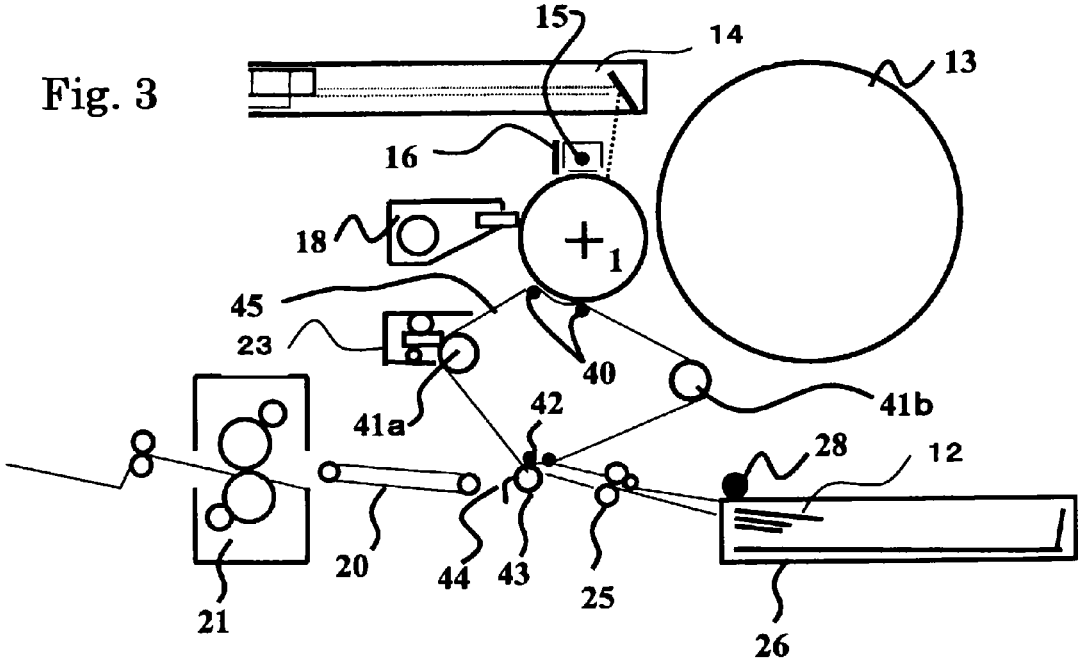
FIG. 3 is a view showing the constitution of an image forming apparatus provided with a developing device according to a rotary rotating mode and an intermediate transfer body.

The developer can be used in, for example, such image forming apparatus as shown in FIG. 3. In the image forming apparatus, an image forming unit group is an image forming unit group in which multiple image forming units are arranged like a circular ring. The image forming apparatus has moving means for rotationally moving the entirety of the image forming unit group to move each of the multiple image forming units to the single image forming position sequentially.

FIG. 3 is a view schematically showing the constitution of an example of a full-color image forming apparatus according to an electrophotographic mode mounted with: a developing unit exchanger 13 having rotary developing units according to a rotary rotating mode for respective colors; and an intermediate transfer body 45. The surface of an electrostatic latent image-bearing member 1 is uniformly charged to have negative polarity by a charging device 15. Next, image exposure corresponding to a first color, for example, a yellow image is performed by an exposing device 14, whereby an electrostatic latent image corresponding to the yellow image is formed on the surface of the electrostatic latent image-bearing member 1.

Figure 5:
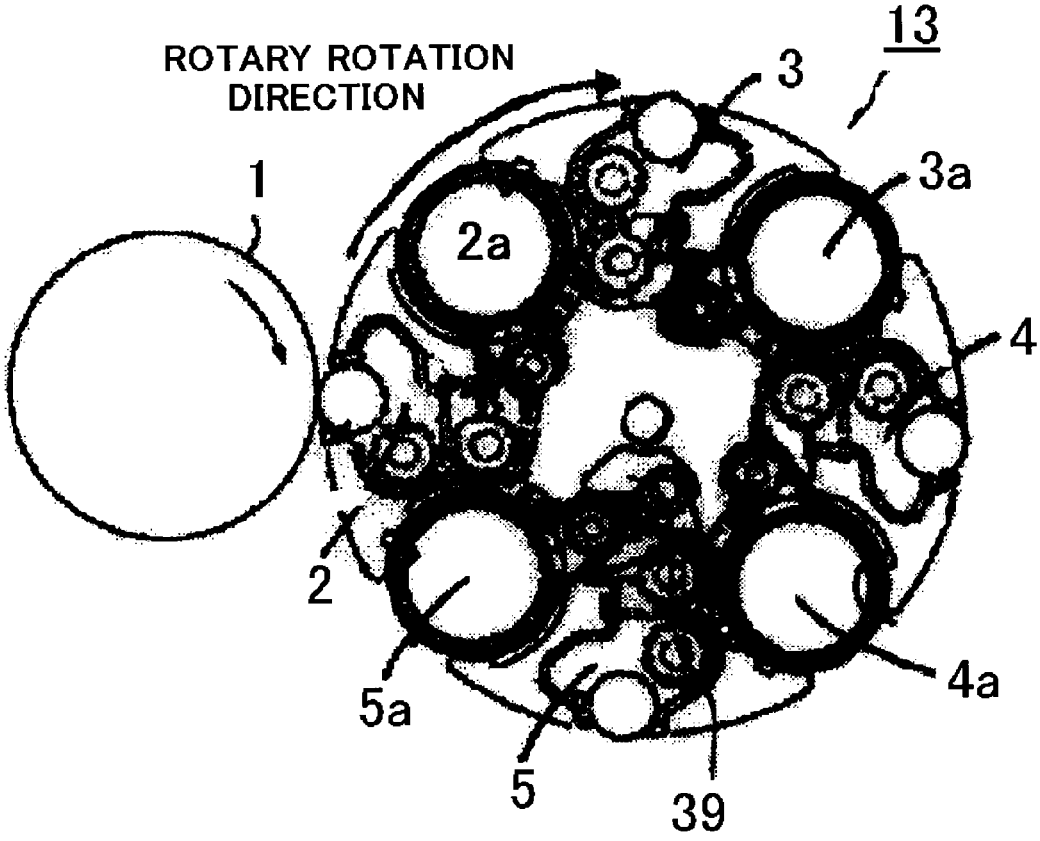
FIG. 5 is an enlarged view showing the constitution of the developing device according to the rotary rotating mode.

The developing unit exchanger 13 is constituted so as to be capable of rotationally moving. FIG. 5 schematically shows the constitution of the exchanger. Before the tip of the electrostatic latent image corresponding to the yellow image reaches a developing position, a yellow developing unit faces the electrostatic latent image-bearing member 1. Then, the electrostatic latent image is rubbed with a magnetic brush, whereby a yellow toner image is formed on the electrostatic latent image-bearing member.

Figure 4:
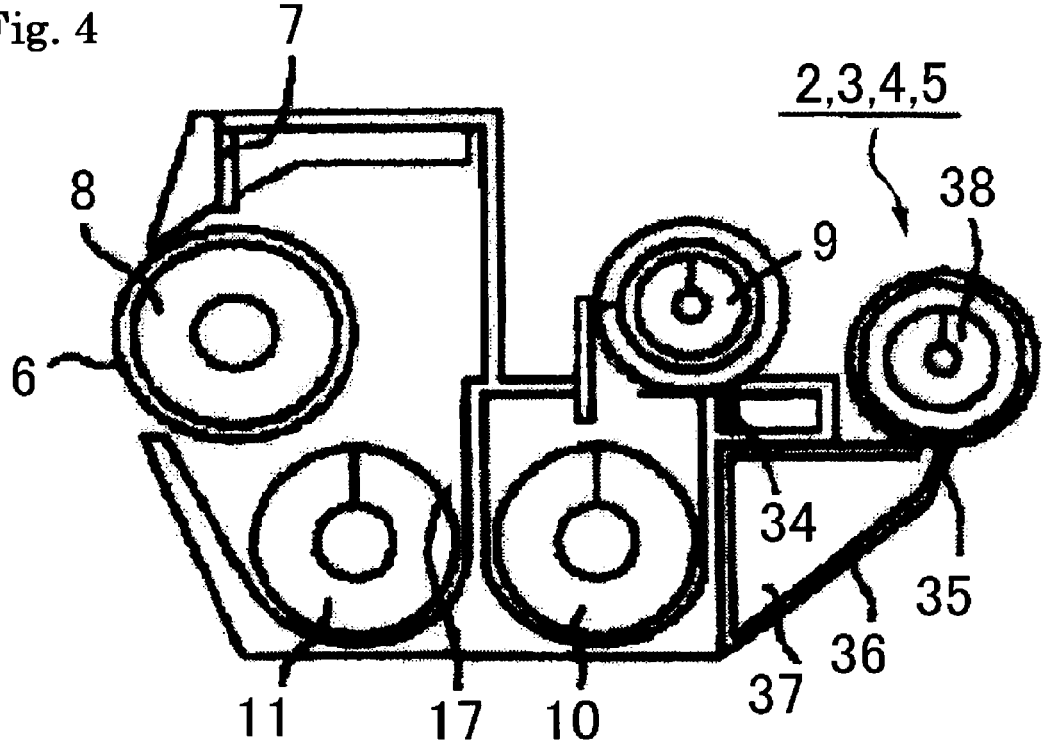
FIG. 4 is an example of a sectional view of a developing unit in the rotary rotating mode.

FIG. 4 is a view schematically showing the constitution of each of developing units 2, 3, 4, and 5 shown in FIG. 5.

As shown in FIG. 4, each developing unit for use in development is provided with, for example, a developing sleeve 6 as a developer carrier, a magnet roller 8, a regulating member 7, developer conveying screws 10 and 11, and a scraper (not shown).

How a developer in a developing unit is conveyed at the time of development will be described with reference to FIG. 4. The developing sleeve 6 includes the fixed magnet roller 8, and is driven and rotated while a predetermined development interval is kept between the sleeve and the peripheral surface of the electrostatic latent image-bearing member 1. It should be noted that the developing sleeve 6 and the electrostatic latent image-bearing member 1 are in contact with each other in some cases. The regulating member 7 has rigidity and magnetism, and is selected from various members such as a member brought into press contact with the developing sleeve 6 under a predetermined load in a state where no developer is interposed between the sleeve and the member and a member arranged while a predetermined interval is kept between the developing sleeve 6 and the member. The pair of developer conveying screws 10 and 11 have screw structures, and exerts the following action: the screws convey and circulate the developer in directions opposite to each other so that toner and a magnetic carrier are sufficiently stirred and mixed before they convey the developer to the developing sleeve 6. The magnet roller 8 may be constituted of, for example, magnets with 4 poles of a magnetic force or magnets with 6 poles in which N poles and S poles are alternately arranged at an equal interval. Alternatively, the magnet roller 8 may be constituted of (6−1), that is, 5 poles and included in a state of being fixed in the developing sleeve 6 in such a manner that a repulsive magnetic field is formed at a portion where the roller is in contact with the scraper to facilitate the peeling of the developer.

The above pair of developer conveying screws 10 and 11 serve also as a pair of stirring members rotating in directions opposite to each other. A developer for replenishment to be replenished is conveyed from a container for storing a developer for replenishment (FIG. 5: 2*a*, 3*a*, 4*a*, or 5*a*) by the thrust of a screw of a device 9 for storing a developer for replenishment, and toner and a magnetic carrier are mixed. A heterogeneous, two-component developer subjected to triboelectric charging by the action of the mixing of the toner and the magnetic carrier is caused to adhere onto the peripheral surface of the developing sleeve 6 in a layer fashion.

The developer on the surface of the developing sleeve 6 forms a uniform layer with the aid of the regulating member 7 provided to be opposed to a magnetic pole of the magnet roller 8. The uniformly formed developer layer develops a latent image on the peripheral surface of the electrostatic latent image-bearing member 1 in a developing region, thereby forming a toner image.

The above toner image is transferred onto the intermediate transfer body 45 by a transfer device 40.

After the completion of the above copy cycle of a yellow, the electrostatic latent image-bearing member 1 that has finished the transfer of yellow toner is then subjected to a pre-cleaning treatment as required. After that, the charge of the member is eliminated by a charge eliminating device, and the yellow toner remaining on the surface of the member is scraped by a cleaning device 18.

Then, the developing unit exchanger 13 rotates in such a manner that the developing units 3, 4, and 5 are sequentially switched to be opposed to the electrostatic latent image-bearing member 1, and magenta, cyan, and black toner images are transferred onto the intermediate transfer body 45 in the same manner as in the above copy cycle.

After the above respective copy cycles have been carried out, toner images corresponding to the respective color components are transferred onto the same position on the intermediate transfer body 45 by the transfer device 40, whereby a single toner image completed by superimposing the toner images corresponding to the respective color components on each other is formed. Meanwhile, transfer materials 12 such as paper and a transparent sheet stored in a sheet feeding tray 26 are fed one by one by a sending roller 28 to registration rollers 25, and each of the transfer materials 12 is conveyed to a space between the intermediate transfer body 45 and a transfer roller 43 in synchronization with the intermediate transfer body 45. The toner image on the intermediate transfer body 45 is transferred onto the conveyed transfer material 12 by the transfer roller 43. After that, the transfer material is separated from the intermediate transfer body 45 by a peeling finger 44, and is introduced into a fixing device 21 by a conveying belt 20. Then, the toner image is fixed to the transfer material 12, and then the material is discharged to the outside, whereby one copy mode is completed. In addition, the charge on the surface of the intermediate transfer body 45 that has transferred its toner image onto the transfer material is eliminated by a charge eliminating device (not shown), and then the surface of the intermediate transfer body is cleaned by a cleaning device 23. Then, the intermediate transfer body waits for the next copy cycle.

When such copying operation as described above is repeated, toner in a developer stored in a developer tank 17 in the developing unit shown in FIG. 4 is gradually consumed, whereby a ratio of toner to a magnetic carrier, that is, a toner concentration starts to reduce. The change in toner concentration is detected by a toner concentration sensor (not shown) provided for the developer tank 17, and the toner concentration is subjected to feedback control in such a manner that the toner concentration always falls within an appropriate range needed for development.

As a result of the above control, the developer for replenishment is discharged from the container for storing a developer for replenishment to the device 9 for storing a developer for replenishment. Next, the developer for replenishment is supplied from a replenishment port of the device 9 for storing a developer for replenishment to the developer tank 17 in the developing unit by the driving force of the screw of the device 9.

In addition, in the automatic refresh development mode, each of the developing units 2, 3, 4, and 5 is replenished with the developer for replenishment of the present invention in which the toner and the magnetic carrier are mixed from each of the containers for storing a developer for replenishment (2*a*, 3*a*, 4*a*, and 5*a*) through the replenishment port of the device 9 for storing a developer for replenishment.

The discharge of an excessive developer from each of the developing units 2, 3, 4, and 5 by utilizing rotational movement in the developing unit exchanger 13 shown in FIG. 5 that rotationally moves will be described with reference to FIGS. 4 and 5.

In a full-color image forming apparatus including the developing unit exchanger 13 having rotary developing units each adopting a rotational movement mode, the developing units 2, 3, 4, and 5 each show rotational movement in the developing unit exchanger 13. At the time of development, each of the units shows rotational movement toward a position opposed to the electrostatic latent image-bearing member 1 to perform development. At the time of non-development, each of the units shows rotational movement toward a position not opposed to the electrostatic latent image-bearing member 1.

For example, at the position where the developing unit 5 is opposed to the electrostatic latent image-bearing member 1 to perform a development operation, an excessive developer (deteriorated magnetic carrier) is spilled from a developer discharge port 34 on a developing unit side provided for the developing unit 5, and moves through an intermediate developer recovery portion 37 and a developer recovery auger 36 owing to a rotation operation. Then, the developer is discharged to a developer recovery container 39 provided for the central axis of rotation of a developing device according to the rotary rotating mode.

To be specific, in a development method in the present invention, development is preferably performed in a state where a magnetic brush is in contact with the electrostatic latent image-bearing member 1 while an alternating voltage is applied to a developing sleeve so that an alternating electric field is formed in a developing region. A distance (S-D distance) between the developing sleeve 6 and the electrostatic latent image-bearing member 1 of 100 to 1,000 μm is desirable in terms of the prevention of the adhesion of a magnetic carrier and an improvement in dot reproducibility. When the distance is narrower than 100 μm, the supply of a developer is apt to be insufficient, so the image density decreases. When the distance exceeds 1,000 μm, lines of magnetic force from a magnetic pole $S_1$ expand, and the density of magnetic brushes decreases. As a result, dot reproducibility is poor, or a restraint force on the magnetic carrier weakens so that adhesion of the magnetic carrier is apt to occur.

The alternating electric field has a peak-to-peak voltage of preferably 300 to 3,000 V, and has a frequency of 500 to 10,000 Hz. The voltage and the frequency can be appropriately selected and used depending on a process. In this case, example of the wave form of an AC bias for forming the alternating electric field include a delta wave, a rectangular wave, a sinusoidal wave, and a wave form with its Duty ratio changed. In some cases, development is preferably performed by applying a development bias voltage having a discontinuous AC bias voltage (intermittent alternating superimposed voltage) to a developing sleeve in order to cope with a change in rate at which a toner image is formed. An applied voltage of less than 300 V hardly provides a sufficient image density. In addition, in this case, fog toner in a non-image portion may not be favorably recovered. In addition, an applied voltage in excess of 3,000 V disturbs a latent image through a magnetic brush, thereby causing a reduction in image quality in some cases.

The use of a two-component developer having favorably charged toner can reduce a fog removal voltage (Vback) and can reduce the primary charging of the electrostatic latent image-bearing member, whereby the lifetime of the electrostatic latent image-bearing member can be lengthened. Vback is preferably 200 V or less, or more preferably 150 V or less, though the preferable range varies depending on a developing system. A contrast electric potential of 100 to 400 V is preferably used in such a manner that a sufficient image density is obtained.

In addition, when the frequency is lower than 500 Hz, sufficient vibration is not applied upon return of the toner in contact with the electrostatic latent image-bearing member to the developing sleeve, so fog is apt to occur, though the degree of fog is related to a process speed. When the frequency exceeds 10,000 Hz, the toner cannot follow the electric field, so a reduction in image quality is apt to occur.

In the development method in the present invention, a width of contact (development abutting portion) between a magnetic brush on the developing sleeve 6 and the electrostatic latent image-bearing member 1 is preferably set to 3 to 8 mm in order that development providing a sufficient image density, excellent in dot reproducibility, and causing no magnetic carrier adhesion may be performed. When the development abutting portion is narrower than 3 mm, it is difficult to satisfy a sufficient image density and dot reproducibility favorably. When the portion is wider than 8 mm, the packing of the developer occurs, so the operation of a machine may be stopped, or it may become difficult to suppress magnetic carrier adhesion sufficiently.

Examples of a method of adjusting the development abutting portion include a method involving adjusting a distance between the regulating member 7 and the developing sleeve 6 and a method involving appropriately adjusting the abutting width by adjusting the distance (S-D distance) between the developing sleeve 6 and the electrostatic latent image-bearing member 1.

The electrostatic latent image-bearing member may be constituted in the same manner as in an electrostatic latent image-bearing member for use in an ordinary image forming apparatus. An example of the electrostatic latent image-bearing member is a photosensitive body constituted by providing, on a conductive substrate made of aluminum, SUS, or the like, a conductive layer, a base layer, a charge-generating layer, a charge-transporting layer, and, as required, a charge-injecting layer in the stated order. The conductive layer, the base layer, the charge-generating layer, and the charge-transporting layer may be those used in an ordinary photosensitive body. The charge-injecting layer, a protective layer, or the like may be used as the outermost layer of the photosensitive body.

Figure 6:
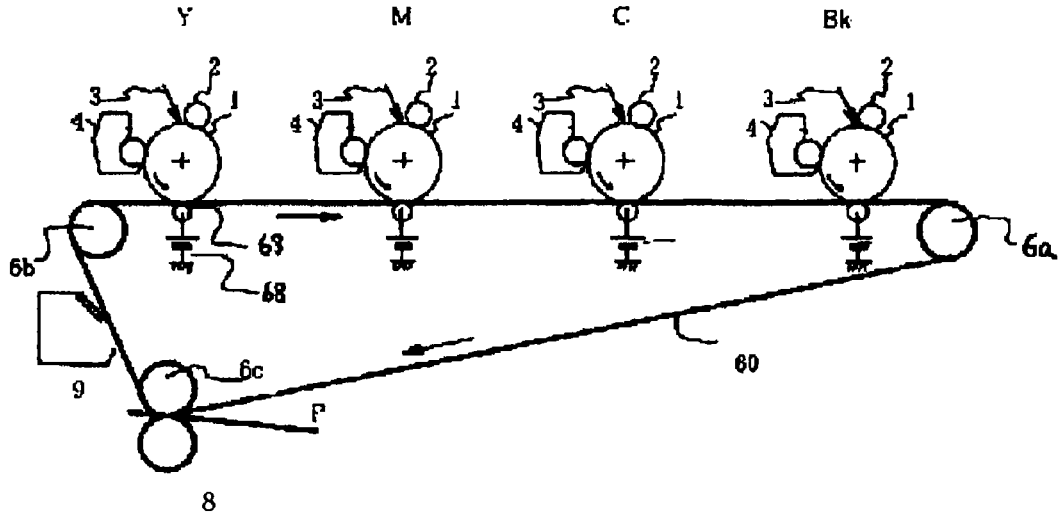
FIG. 6 is a view showing the constitution of an image forming apparatus according to a tandem mode.

A color laser printer shown in FIG. 6 is a printer according to a four-continuous drum mode (inline) which: has multiple developing units; and performs multi layer transfer continuously onto an intermediate transfer belt 60 as a second image-bearing member once to provide a full-color print image.

In FIG. 6, the endless intermediate transfer belt 60 is suspended around a driving roller 6*a*, a tension roller 6*b*, and secondary transfer opposing rollers 6*c*, and rotates in the direction indicated by an arrow shown in the figure.

Four developing units are arranged in series along the above intermediate transfer belt 60 to correspond to respective colors.

A photosensitive drum 1 arranged in the developing unit for performing development with yellow toner is uniformly charged to have predetermined polarity and a predetermined electric potential by a primary charging roller 2 in the course of its rotation, and is then subjected to image exposure 3 by image exposing means (not shown) (such as a color separation/image formation exposure optical system for a color copy image or a scanning exposure system based on laser scan that outputs a laser beam modulated in correspondence with a time-series electrical digital pixel signal of image information), whereby an electrostatic latent image corresponding to a first color component image (yellow component image) of a target color image is formed.

Next, the electrostatic latent image is developed with the yellow toner as a first color by a first developing unit (yellow developing unit).

In FIG. 6, the yellow image formed on the photosensitive drum 1 enters a primary transfer nip portion between the drum and the intermediate transfer belt 60. At the transfer nip portion, a flexible electrode 63 is brought into contact and abutment with the back side of the intermediate transfer belt 60. The flexible electrodes 63 have primary transfer bias sources 68 for the respective developing units so that a bias can be applied at each port independently. The intermediate transfer belt 60 first transfers yellow at a port for a first color, and then performs multi layer transfer of the respective colors, that is, magenta, cyan, and black sequentially at the respective ports from the photosensitive drums 1 corresponding to the colors through the same step as that described above.

Four full-color images formed on the intermediate transfer belt 60 are then collectively transferred by a secondary transfer roller 8 onto a transfer material P, and are melted and fixed by a fixing device (not shown), whereby a color print image is obtained.

Secondary transfer residual toner remaining on the intermediate transfer belt 60 is cleaned with a blade of an intermediate transfer belt cleaner 9 before the belt prepares for the next image forming step.

Upon selection of a material for the above transfer belt 60, a material that expands and contracts is not desirable in order that registration at each color port may be good. A resin-based belt, a rubber belt with a metal core, or a belt composed of resin and rubber which are adhered to each other, are preferable.

An automatic refresh development method that can be employed in the present invention will be described with reference to FIGS. 6 and 7.

Figure 7:
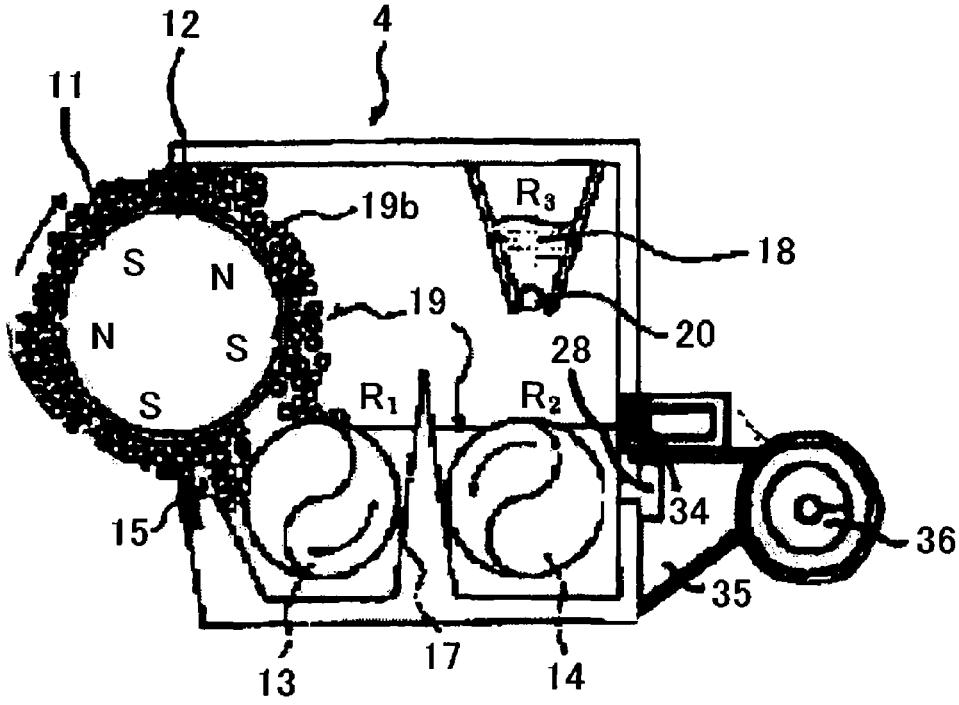
FIG. 7 is an example of a sectional view of a developing unit for use in the tandem mode.

In the development operation of the developing unit 4 of each of FIGS. 6 and 7 employing the automatic refresh development mode, the developing unit 4 is replenished with a developer for replenishment in which toner and a magnetic carrier are mixed from a storage room $R_3$ for a developer for replenishment through a replenishment port 20.

Upon repetition of the development operation, an excessive developer (deteriorated magnetic carrier) is spilled from the developer discharge port 34 on a developing unit side provided for the developing unit 4, and is discharged to a developer recovery container (not shown) from a developer intermediate recovery chamber 35 through the developer recovery auger 36.

Hereinafter, suitable methods of measuring physical properties of a material and the like to be used in the present invention will be described.

When the physical properties of a magnetic carrier are measured from a developer for replenishment and a two-component developer, each developer is washed with ion-exchanged water containing 1% of a surfactant (preferably a sodium dodecylbenzene sulfonate) so that the toner and the magnetic carrier are separated before measurement is performed.

<Method of Measuring True Specific Gravity of Magnetic Carrier>

The true specific gravity of the magnetic carrier to be used in the present invention can be measured by using a dry automatic densimeter Autopicnometer (manufactured by Yuasa Ionics Inc.). The measurement apparatus involves measuring the true density of a solid or a liquid on the basis of a gas phase substitution method. The gas phase substitution method, which is based on Archimedes' principle as in the case of a liquid phase substitution method, is characterized in that the accuracy of measurement is high because a gas is used as a substitution medium.

<Method of Measuring Particle Diameter of Magnetic Carrier>

The particle diameter of a carrier is measured with a laser diffraction type grain size distribution measuring device SALD-300 V (manufactured by Shimadzu Corporation), and a 50% particle diameter on a volume basis (D50) is calculated.

<Method of Measuring Primary Number Average Particle Diameter of Fine Particles in Resin Component>

A focused ion beam processing and observing device (FIB) FB-2000 C (Hitachi, Ltd.) was used to perform processing and observation. Sample preparation is performed as follows: an aqueous solution of a carbon paste is applied to a sample table, and a small amount of a sample (carrier) is mounted on the resultant. After that, the sample is set in the FIB device without the performance of platinum deposition, and the target surface of the sample is irradiated with a beam. As a result, a projection caused by a particle can be observed. The diameter of the projection is measured. The measurement is performed on 3 sites sampled from each of 20 randomly sampled carrier sectional photographs. That is, the measurement is performed on a total of 60 sites, and the calculated average value of the measured values for the 60 sites is defined as the primary number average particle diameter of fine particles.

<Method of Measuring Magnetic Carrier Concentration in Developer for Replenishment>

5 g of a developer for replenishment were washed with an ion-exchanged water containing 1% of a surfactant (preferably a sodium dodecylbenzene sulfonate), and toner was separated from a magnetic carrier. After that, the remainder was dried and subjected to moisture conditioning (25.0° C./60% RH). Then, the concentration of the magnetic carrier in the developer for replenishment was calculated by computing the mass of the magnetic carrier in the developer for replenishment.

<Method of Measuring Volume Specific Resistivity of Fine Particle>

Figure 2:
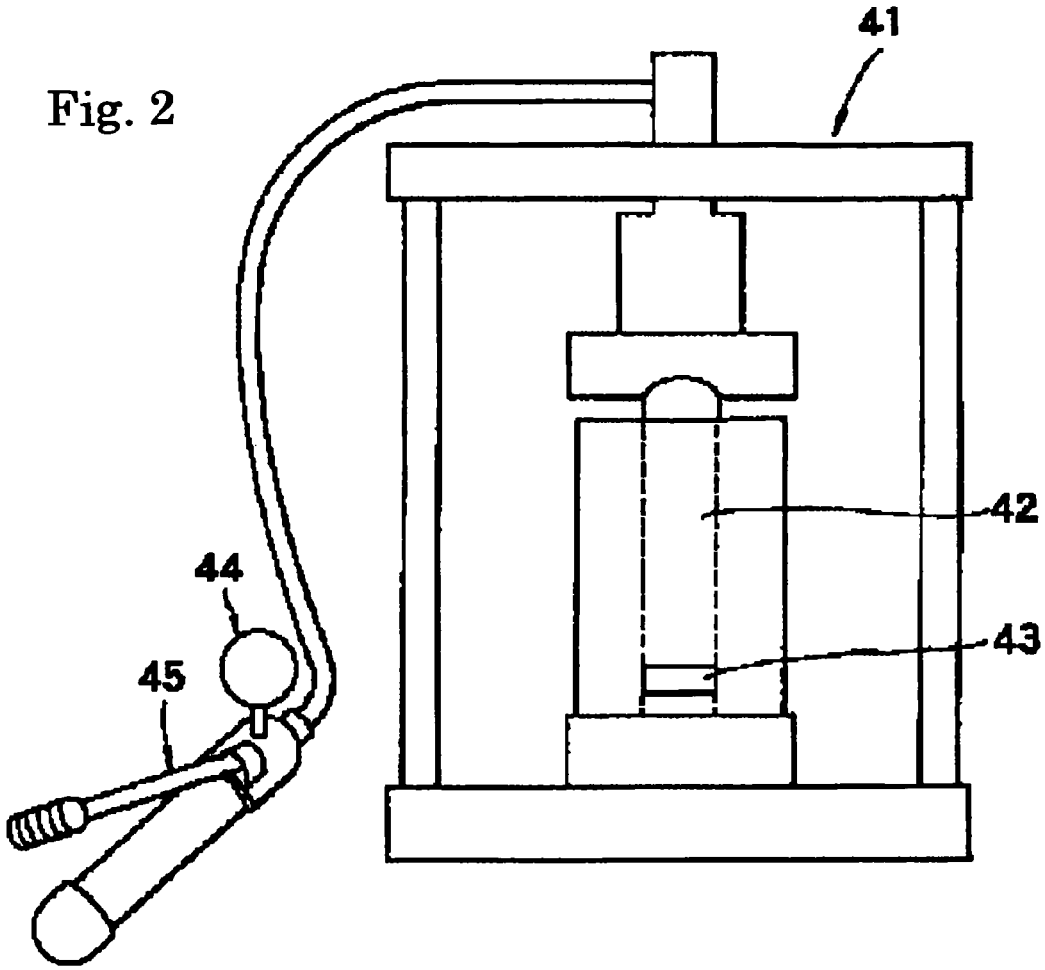
FIG. 2 is a view of a tablet molding machine to be used upon measurement of the volume specific resistivity of a particle.

A sample is molded into a tablet by using a device shown in FIG. 2. First, about 0.3 g of the sample is loaded into a tablet molding room. Next, a push-rod 42 is inserted into the tablet molding room, and then the sample is pressurized with a hydraulic pump 45 at 250 kg/cm$^2$ for 5 minutes, whereby a pellet-like tablet having a diameter of about 13 mm and a height of about 2 to 3 mm is molded. The front surface and back surface of the tablet obtained here are each coated with a conductive agent as required. The resistance R(Ω) of the sample upon application of a voltage of 1,000 V is measured under an environment having a temperature of 23.5° C. and a humidity of 65% RH by using, for example, a 16008 A RESISTIVITY CELL manufactured by HEWLETT PACKARD or a 4329 A HIGH RESISTANCE METER manufactured by the company. Then, a specific resistivity ρ (Ω·cm) is determined from the following formula (4):

$$\rho = R \times S/l \tag{4}$$

(where S (cm$^2$) represents the sectional area of the sample and l (cm) represents the height of the sample).

<Method of Measuring Average Circularity and Coefficient of Variation of Magnetic Carrier>

The average circularity and coefficient of variation of each of the magnetic carrier and the magnetic carrier core were calculated as described below by using a multi-image analyzer (trade name: Multisizer, manufactured by Beckman Coulter, Inc).

The multi-image analyzer is obtained by combining a grain size distribution measuring device according to an electrical resistance method with a function of photographing a particle image with a CCD camera and a function of analyzing the photographed particle image. The foregoing will be detailed below. The above Multisizer detects a change in electrical resistance when particles uniformly dispersed in an electrolytic solution by an ultrasonic wave or the like pass the aperture of the above Multisizer, and causes a stroboscope to emit light in synchronization with the detection, thereby photographing the image of the above particles with the CCD camera. The particle image is captured in a personal computer, binarized, and subjected to image analysis.

The device can analyze not only grain size data on a circle-equivalent diameter, the longest diameter, an area, and a sphere-equivalent diameter but also various shapes such as an average circularity, the degree of irregularities, an aspect ratio, and a ratio between an envelope circumferential length and a circumferential length from the above particle image. Further, a method of introducing a sample adopted by the device is of a continuous type. Accordingly, even a magnetic carrier which has a high specific gravity so that the carrier is apt to sediment and which is hardly dispersed in a solution can be measured with good reproducibility.

Circularity is represented by the following equation (5-1). An average circularity is represented by the following equation (5-2). As a particle shape is closer to a circular shape, a value for the average circularity is closer to 1. As the particle shape is more elongated, the value for the average circularity becomes smaller. The average circularity is calculated by: summing the circularities of the respective particles; and dividing the sum by the total number of the particles. In addition, a coefficient of variation can be determined from the following equation (5-3).

$$\text{Circularity}=((4\times\text{area})/(\text{maximum length})^2)\times(1/\pi) \quad (5\text{-}1)$$

[Eq. 1]

$$\text{Average circularity: } \bar{x} = \frac{\sum Xn}{N} \quad (5\text{-}2)$$

[Eq. 2]

$$\text{Standard deviation: } SD = \sqrt{\frac{\sum\left((X_n - \bar{X})^2\right)}{N}}$$

$$\text{Coefficient of variation (\%): } = \frac{SD}{\bar{X}} \times 100 \quad (5\text{-}3)$$

A specific measurement method is as described below. A solution prepared by mixing an aqueous solution of NaCl having a concentration of about 1% and glycerin at a ratio of 50 vol %:50 vol % is used as an electrolyte solution. Here, the aqueous solution of NaCl has only to be prepared by using reagent-grade sodium chloride. For example, an ISOTON (registered tradename)-II (manufactured by Coulter Scientific Japan, Co.) may be used. Glycerin has only to be an analytical reagent-grade reagent or a reagent-grade reagent.

The above electrolyte solution (about 30 ml) is added with 0.1 to 1.0 ml of a surfactant (preferably a sodium dodecyl benzene sulfonate) as a dispersant. Further, 2 to 20 mg of a measurement sample are added to the mixture. The electrolyte solution into which the sample has been suspended is subjected to a dispersion treatment by using an ultrasonic dispersing unit for about 1 minute, whereby a dispersion liquid is obtained.

The above electrolyte solution and the above dispersion liquid are charged into a glass measuring container so that the concentration of carrier particles in the measuring container is set to 5 to 10 vol %. The contents in the glass measuring container are stirred at the maximum stirring speed. The pressure at which the sample is sucked is set to 10 kPa. When the specific gravity of a carrier is so large that the carrier is apt to sediment, a measuring time is set to 15 to 30 minutes. In addition, every 5 to 10 minutes, measurement is suspended, and replenishment with a sample liquid and replenishment with the mixed solution of the electrolyte solution and glycerin are performed.

A lens having a 200-μm aperture and a magnification of 20 is used for photographing a particle image. Measurement conditions are as follows: average luminance in a measuring frame is set to 220 to 230, a measuring frame setting is 300, and a binarization level is set to 180.

A particle image is photographed with a CCD camera by causing a stroboscope to emit light with the aid of the pulse of a change in electrical resistance when a particle passes the aperture as a trigger. It is a threshold (SH) value that sets a threshold for the pulse. The SH value, which is basically set to 50, must be set to an optimum value depending on the state of the sample. The optimum value is identified on the basis of the extent to which a particle image to be photographed blurs. As a guide, measurement was performed while the rate at which particle images were photographed was set to 10 to 20 images/sec.

The above particle image is captured in a personal computer, binarized, and subjected to image analysis. The number of particles to be measured is 2,000. After the completion of the measurement, a blurred image and agglomerated particles (multiple particles are simultaneously measured) are removed in a particle image screen by using main body software. Through image analysis, pieces of grain size data on the circle-equivalent diameter, longest diameter, area, and sphere-equivalent diameter of a particle, and particle shape data on the average circularity, degree of irregularities, aspect ratio, and ratio between an envelope circumferential length and a circumferential length of the particle are obtained.

<Method of Measuring Weight Average Particle Diameter of Toner>

In the present invention, the weight average particle diameter (D4) and grain size distribution of toner were measured by using a Coulter Multisizer (manufactured by Beckman Coulter, Inc). A 1% aqueous solution of NaCl prepared by using reagent-grade sodium chloride was used as an electrolyte solution. For example, an ISOTON R-II can be used as an electrolyte solution.

100 to 150 ml of the above electrolyte aqueous solution were added with 0.1 to 5 ml of a surfactant, or preferably a sodium dodecyl benzene sulfonate as a dispersant. Further, 2 to 20 mg of a measurement sample were added to the mixture.

The electrolyte solution into which the above measurement sample had been suspended was subjected to a dispersion treatment by using an ultrasonic dispersing unit for about 1 to 3 minutes, and was then subjected to the above measuring device using an aperture tube diameter of 100 μm. The volume and number of toner particles each having a particle diameter of 2.00 μm or more were measured, and a volume distribution and a number distribution were calculated. Then, the weight average particle diameter (D4) was determined (the central value of each channel was defined as a representative value for the channel).

The 13 channels to be used had a size of: 2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm, respectively.

<Method of Measuring Triboelectric Charge Amount of Toner>

Figure 8:
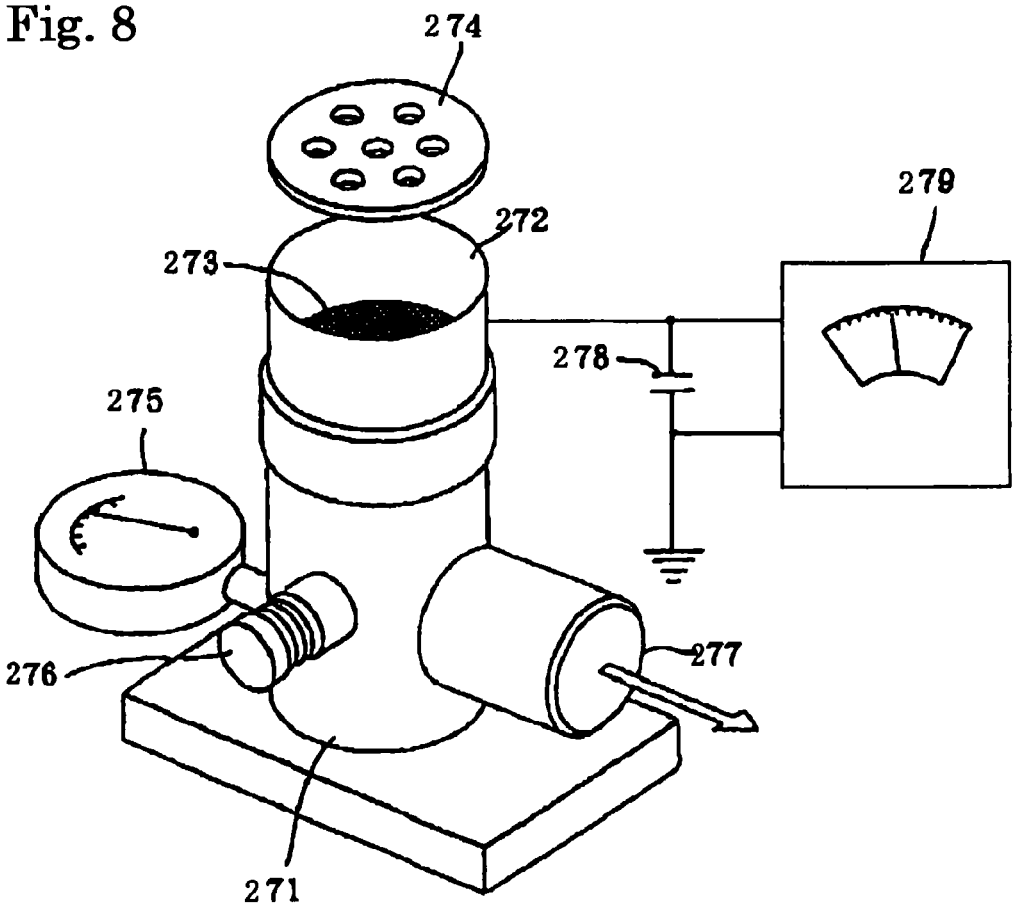
FIG. 8 is a view of a device used for measuring a triboelectric charge amount in any example.

FIG. 8 schematically shows a device for measuring a triboelectric charge amount. A metallic measuring container 272 having a 500-mesh screen (aperture 25 μm) 273 at its bottom was filled with about 0.5 to 1.5 g of a two-component developer collected from the upper portion of a developing sleeve of a copying machine or printer, and was covered with a metal lid 274. The mass of the entirety of the measuring container 272 at this time was measured, and was represented by W1 (g). Next, toner was sucked by using a sucking machine 271 (at least part of which in contact with the measuring container 272 was an insulator) from a suction port 277, and the pressure indicated by a vacuum gauge 275 was set to 250 mmAq by adjusting an air flow control valve 276. Suction was performed in this state sufficiently, or preferably for 2 minutes so that the toner was sucked and removed. The electric potential indicated by a potentiometer 279 at this time was represented by V (volt). Here, a capacitor 278 had a capacity of C (mF). In addition, the weight of the entirety of the measuring container after the suction was measured, and was represented by W2 (g). The triboelectric charge amount (mC/kg) of the toner was calculated from the following equation (6):

$$\text{Triboelectric charge amount of toner (mC/kg)}=C\times V/(W1-W2) \quad (6)$$

(provided that measurement was performed at 23° C. and 60% RH).

<Measuring Method for Circle Equivalent Diameter and Average Circularity of Toner>

Circle equivalent diameter and circularity of the toner were measured by using a flow type particle image measuring device "FPIA-2100" (manufactured by SYSMEX CORPORATION), and calculated from the following equation (7) and (8).

[Eq. 3]

$$\text{Circle equivalent diameter}=(\text{particle projection area}/\pi)^{1/2}\times 2 \quad (7)$$

$$\text{Circularity}=\text{surrounding length of circle having the same area as particle projection area}/\text{surrounding length of particle projection image} \quad (8)$$

Here, the term "particle projection area" means a binarized toner image area, and the term "surrounding length of particle projection image" is defined as a length of a border line which is obtained by connecting edge points of the toner image. In the measurement, a surrounding length of the particle image, which was obtained through image processing at the degree of definition in image processing of 512×512 (i.e., pixels in 0.3 μm×0.3 μm), was used.

An average circularity of the present invention is an index showing the degree of irregularity of the toner. The average circularity shows 1.000 when the toner has a complete circular shape, and shows a lower value as the surface form becomes complicated.

An average circularity C, which means an average value of a circularity frequency distribution, is calculated from the following equation (9) where ci denotes a circularity at a division point i (i.e., center value) in the particle size distribution and m denotes the number of the measured particles.

[Eq. 4]

$$\text{Average circularity } C = \sum_{i=1}^{m} Ci/m \quad (9)$$

A specific measurement method was as follows. 10 ml of ion-exchange water from which an impurity solid or the like had been removed in advance was charged into a vessel, and a surfactant as a dispersant, preferably an alkyl benzene sulfonate (preferably a sodium dodecylbenzene sulfonate), was added to the ion-exchange water. After that, 0.02 g of a measurement sample was further added to be uniformly dispersed in the mixture. The resultant mixture was subjected to dispersion treatment for 2 minutes by using an ultrasonic dispersing unit "Tetora 150" (manufactured by Nikkaki-Bios) as a dispersing means to prepare a dispersion for measurement. At that time, the dispersion was cooled as appropriate to prevent the temperature of the dispersion from reaching 40° C. or more. In addition, in order to prevent unevenness of the average circularities, the environment where the flow type particle image measuring device FPIA-2100 was set was controlled to the temperature of 23° C.±0.5° C. such that the temperature in the device was in the range of 26 to 27° C., and an automatic focusing was performed by using 2 μm latex particles at intervals of a certain period of time, or preferably performed every 2 hours.

The flow type particle image measuring device was used for an average circularity measurement of the toner. The concentration of the dispersion was readjusted in such a manner that a concentration of the toner upon the measurement may be in the range of 3,000 to 10,000 particles/μl. Then, 1,000 or more particles of the toner were measured. After the measurement, an average circularity of the toner was determined by using the obtained data while cutting off data for particles each having a circle equivalent diameter of less than 2 μm.

EXAMPLES

Hereinafter, specific examples of the present invention will be described. However, the present invention is not limited to these examples.

<Production Example of Magnetic Carrier Core>

(Method of Producing Magnetic Carrier Core 1)

26.0 mol % of MnO, 3.0 mol % of MgO, 70.0 mol % of $Fe_2O_3$, and 1.0 mol % of $SrCO_3$ as ferrite components were pulverized in a wet ball mill for 5 hours, mixed, and dried. The resultant dried product was held at 900° C. for 3 hours and preliminarily calcined. The preliminarily calcined product was pulverized in a wet ball mill for 7 hours into particles each having a particle diameter of 2 μm or less. 2.0 mass % of a binder (polyvinyl alcohol) were added to the resultant slurry, and then the whole was granulated and dried with a spray dryer (manufacturer: OHKAWARA KAKOHKI Co., LTD), whereby a granulated product having a 50% particle diameter on a volume basis (D50) of about 40 μm was obtained. The granulated product was loaded into an electric furnace, and was held at 1,150° C. for 3 hours and calcined in a mixed gas with its oxygen concentration in a nitrogen gas adjusted to 2.0 vol %. The resultant calcined product was shredded and screened with a sieve (aperture 75 μm), whereby a magnetic carrier core 1 (ferrite core) having a 50% particle diameter on a volume basis (D50) of 40 μm was obtained. The observation of the surface of the core with an SEM showed that the surface of the core had grooves.

(Method of Producing Magnetic Carrier Core 2)

A magnetic carrier core 2 (ferrite core) was produced in the same manner as in the magnetic carrier core 1 except that calcination was performed at 1,300° C. The observation of the surface of the core with an SEM showed that the surface of the core had a small number of grooves. However, was smooth as compared to that of the magnetic carrier core 1.

(Method of Producing Magnetic Carrier Core 3)

20.0 mol % of MgO, 58.0 mol % of $Fe_2O_3$, and 22.0 mol % of $SrCO_3$ as ferrite components were pulverized in a wet ball mill for 5 hours, mixed, and dried. The resultant dried product was held at 900° C. for 3 hours and preliminarily calcined. The preliminarily calcined product was pulverized in a wet ball mill for 7 hours into particles each having a particle diameter of 2 μm or less. 1.0 mass % of a binder (polyvinyl alcohol) and 2.0 mass % of sodium hydrogen carbonate as an electron hole adjuster were added to the resultant slurry, and then the whole was granulated and dried with a spray dryer (manufacturer: OHKAWARA KAKOHKI Co., LTD), whereby a granulated product having a 50% particle diameter on a volume basis (D50) of about 40 μm was obtained. The granulated product was loaded into an electric furnace, and was held at 1,150° C. for 3 hours and calcined in a mixed gas with its oxygen concentration in a nitrogen gas adjusted to 2.0 vol %. The resultant calcined product was shredded and screened with a sieve (aperture 75 μm), whereby a magnetic carrier core 3 (ferrite core) having a 50% particle diameter on a volume basis (D50) of 40 μm was obtained. The observation of the core with an SEM showed that the core had a porous structure compared to the magnetic carrier core 1.

(Method of Producing Magnetic Carrier Core 4)

A magnetic carrier core 4 (ferrite core) was produced in the same manner as in the magnetic carrier core 1 except that: ferrite components were changed to 58.0 mol % of LiO and 42.0 mol % of $Fe_2O_3$; and calcination was performed at 1,300° C. The observation of the surface of the magnetic carrier core with an SEM showed that the surface of the core had a small number of grooves and was as smooth as that of the magnetic carrier core 2.

(Method of Producing Magnetic Carrier Core 5)

A magnetic carrier core 5 (ferrite core) was produced in the same manner as in the magnetic carrier core 2 except that a step of stirring a magnetic carrier core obtained after calcination in a Nauta mixer (manufacturer: Hosokawa Micron Corporation) at 200 rpm for 3 hours was added. The observation of the surface of the core with an SEM showed that the surface of the core had nearly no grooves and was smoother than that of the magnetic carrier core 2.

(Method of Producing Magnetic Carrier Core 6)

A magnetic carrier core 6 (ferrite core) was produced in the same manner as in the magnetic carrier core 1 except that grain size adjustment was performed by performing additional classification with an air classifier (Elbow jet: manufactured by Nittetsu Mining Co., Ltd.) after screening with a sieve. A grain size distribution sharper than that of the magnetic carrier core 1 was obtained.

(Method of Producing Magnetic Carrier Core 7)

A magnetic carrier core 7 (ferrite core) was produced in the same manner as in the magnetic carrier core 1 except that: ferrite components were changed to 5.0 mol % of BaO, 10.0 mol % of NiO, 20.0 mol % of ZnO, and 65.0 mol % of $Fe_2O_3$; and calcination was performed at 1,300° C. The observation of the surface of the magnetic carrier core with an SEM showed that the surface of the core had grooves many of which had irregular shapes.

(Method of Producing Magnetic Carrier Core 8)

A magnetic carrier core 8 (ferrite core) was produced in the same manner as in the magnetic carrier core 1 except that conditions for granulation with a spray dryer and for screening were changed in such a manner that a 50% particle diameter on a volume basis (D50) of 70 μm would be obtained.

(Method of Producing Magnetic Carrier Core 9)

A magnetic carrier core 9 (ferrite core) was produced in the same manner as in the magnetic carrier core 1 except that conditions for granulation with a spray dryer and for screening were changed in such a manner that a 50% particle diameter on a volume basis (D50) of 14 μm would be obtained.

<Method of producing magnetic carrier>
(Method of producing magnetic carrier 1)

| | |
|---|---|
| Straight silicone resin (KR 255 manufactured by Shin-Etsu Chemical Co., Ltd.) | 100 parts by mass (in terms of a solid content) |
| Silane-based coupling agent (γ-aminopropylethoxysilane) | 10 parts by mass |
| Carbon black (number average particle diameter 30 nm, DBP oil absorption 50 ml/100 g) | 10 parts by mass |

The above components were mixed with 300 parts by mass of xylene, whereby a magnetic carrier resin coating solution was prepared. While being stirred by using a fluid bed heated to 70° C., the resin coating solution was applied to the magnetic carrier core 1 in such a manner that a ratio of the mass of the straight silicone resin to the mass of the magnetic carrier core would be 12.0 mass %, and was subjected to a solvent removal operation. Further, the resultant was treated by using an oven at 230° C. for 2.5 hours, and was then shredded and classified with a sieve (aperture 75 μm), whereby a magnetic carrier 1 was obtained. Table 1 shows the components and physical properties of the magnetic carrier.

Methods of Producing Magnetic Carriers 2 and 3)

Magnetic carriers 2 and 3 were each produced in the same manner as in the magnetic carrier 1 except that the amount of the resin component with which the magnetic carrier core was coated was changed. Table 1 shows the components and physical properties of the magnetic carriers.

(Methods of Producing Magnetic Carriers 4 and 5)

Magnetic carriers 4 and 5 were each produced in the same manner as in the magnetic carrier 1 except that: the magnetic carrier core 2 was used; and the amount of the resin component with which the magnetic carrier core was coated was changed. Table 1 shows the components and physical properties of the magnetic carriers.

(Methods of Producing Magnetic Carriers 6 to 8)

Magnetic carriers 6 to 8 were each produced in the same manner as in the magnetic carrier 1 except that: the magnetic carrier core 3 was used; and the amount of the resin component with which the magnetic carrier core was coated was changed. Table 1 shows the components and physical properties of the magnetic carriers.

(Method of Producing Magnetic Carrier 9)

A magnetic carrier 9 was produced in the same manner as in the magnetic carrier 8 except that the amount of the resin with which the magnetic carrier core was coated was divided into two portions and the core was coated twice. Table 1 shows the components and physical properties of the magnetic carrier.

(Method of producing magnetic carrier 10)

| | |
|---|---|
| Straight silicone resin (KR 255 manufactured by Shin-Etsu Chemical Co., Ltd.) | 100 parts by mass (in terms of a solid content) |
| Silane-based coupling agent (γ-aminopropylethoxysilane) | 10 parts by mass |
| Carbon black (number average particle diameter 30 nm, DBP oil absorption 50 ml/100 g) | 10 parts by mass |
| Polymethyl methacrylate resin particles (crosslinked PMMA fine particles) (MP 300 manufactured by Soken Chemical & Engineering Co., Ltd., volume average particle diameter 100 nm, volume specific resistivity $2.4 \times 10^{15}$ Ω · cm) | 10 parts by mass |

The above components were mixed with 300 parts by mass of xylene, whereby a magnetic carrier resin coating solution was prepared. While being stirred by using a fluid bed heated to 70° C., the resin coating solution was applied to the magnetic carrier core 2 in such a manner that a ratio of the mass of the straight silicone resin to the mass of the magnetic carrier core would be 10.0 mass %, and was subjected to a solvent removal operation. Further, the resultant was treated by using an oven at 230° C. for 2.5 hours, and was then shredded and classified with a sieve (aperture 75 μm), whereby a magnetic carrier 10 was obtained. Table 1 shows the components and physical properties of the magnetic carrier.

(Methods of Producing Magnetic Carriers 11 to 13)

Magnetic carriers 11 to 13 were each produced in the same manner as in the magnetic carrier 10 except that added fine particles shown in Table 1 were used. Table 1 shows the components and physical properties of the magnetic carriers.

(Method of Producing Magnetic Carrier 14)

A magnetic carrier 14 was produced in the same manner as in the magnetic carrier 1 except that: the magnetic carrier core 4 was used; and the amount of the resin with which the magnetic carrier core was coated was changed. Table 2 shows the components and physical properties of the magnetic carrier.

(Method of Producing Magnetic Carrier 15)

A magnetic carrier 15 was produced in the same manner as in the magnetic carrier 1 except that: the magnetic carrier core 5 was used; and the amount of the resin with which the magnetic carrier core was coated was changed. Table 2 shows the components and physical properties of the magnetic carrier.

(Methods of Producing Magnetic Carriers 16 to 19)

Magnetic carriers 16 to 19 were each produced in the same manner as in the magnetic carrier 1 except that any one of the magnetic carrier cores 6 to 9 was used. Table 2 shows the components and physical properties of the magnetic carriers.

| (Method of producing magnetic carrier 20) | |
|---|---|
| Straight silicone resin (KR 255 manufactured by Shin-Etsu Chemical Co., Ltd.) | 100 parts by mass (in terms of a solid content) |
| Silane-based coupling agent (γ-aminopropylethoxysilane) | 10 parts by mass |

The above components were mixed with 300 parts by mass of xylene, whereby a magnetic carrier resin coating solution was prepared. While being stirred by using a fluid bed heated to 70° C., the resin coating solution was applied to the magnetic carrier core 1 in such a manner that a ratio of the mass of the straight silicone resin to the mass of the magnetic carrier core would be 5.0 mass %, and was subjected to a solvent removal operation. Further, the resultant was treated by using an oven at 230° C. for 2.5 hours, and was then shredded and classified with a sieve (aperture 75 μm), whereby a magnetic carrier 20 was obtained. Table 2 shows the components and physical properties of the magnetic carrier.

| (Method of producing magnetic carrier 21) | |
|---|---|
| Magnetic carrier 20: | 100 parts by mass |
| Toluene: | 14 parts by mass |
| Cyclohexyl methacrylate-methyl methacrylate copolymer (CHMA-MMA) (component ratio 50:50): | 3.0 parts by mass |
| Carbon black (REGAL 330; manufactured by CABOT): | 0.5 part by mass |

The above components except the magnetic carrier 20 were stirred and dispersed by using a stirrer for 60 minutes, whereby a raw material solution for forming a coating layer was prepared. Next, the raw material solution and the magnetic carrier 20 were stirred in a Nauta mixer at 70° C., the raw material solution was applied to the magnetic carrier core, and the stirred magnetic carrier core was subjected to a solvent removal operation. Further, the resultant was treated by using an oven at 230° C. for 2.5 hours, whereby a magnetic carrier 21 was produced.

| (Method of producing magnetic carrier 22) | |
|---|---|
| Magnetic carrier 20: | 100 parts by mass |
| Toluene: | 14 parts by mass |
| Styrene-methacrylate copolymer (component ratio 90:10): | 3.0 parts by mass |
| Carbon black (Rega 1330; manufactured by CABOT): | 0.5 part by mass |
| Resin fine particles (crosslinked melamine resin particles; number average particle diameter 300 nm, manufactured by Soken Chemical & Engineering Co., Ltd.): | 0.5 part by mass |

The above components except the magnetic carrier 20 were stirred and dispersed by using a stirrer for 60 minutes, whereby a raw material solution for forming a coating layer was prepared. Next, the raw material solution and the magnetic carrier 20 were stirred in a Nauta mixer at 70° C., the raw material solution was applied to the magnetic carrier core, and the stirred magnetic carrier core was subjected to a solvent removal operation. Further, the resultant was treated by using an oven at 230° C. for 2.5 hours, whereby a magnetic carrier 22 was produced.

TABLE 1

| | | Resin layer | | Added particles 1 | Added particles 2 | | Volume specific |
|---|---|---|---|---|---|---|---|
| Carrier name | Core | Kind of resin | (mass %) | Kind | Kind | Addition amount (mass %) | resistivity of each of added particles (Ωcm) |
| Magnetic carrier 1 | Magnetic carrier core 1 | Silicone resin | 12 | CB | — | — | — |
| Magnetic carrier 2 | Magnetic carrier core 1 | ↑ | 5 | CB | — | — | — |
| Magnetic carrier 3 | Magnetic carrier core 1 | ↑ | 20 | CB | — | — | — |
| Magnetic carrier 4 | Magnetic carrier core 2 | ↑ | 3 | CB | — | — | — |
| Magnetic carrier 5 | Magnetic carrier core 2 | ↑ | 10 | CB | — | — | — |
| Magnetic carrier 6 | Magnetic carrier core 3 | ↑ | 12 | CB | — | | |

TABLE 1-continued

| | | | | | | | |
|---|---|---|---|---|---|---|---|
| Magnetic carrier 7 | Magnetic carrier core 3 | ↑ | 7 | CB | — | | |
| Magnetic carrier 8 | Magnetic carrier core 3 | ↑ | 25 | CB | — | | |
| Magnetic carrier 9 | Magnetic carrier core 3 | ↑ | 25 | CB | — | — | — |
| Magnetic carrier 10 | Magnetic carrier core 2 | ↑ | 10 | CB | PMMA | 1 | $2.4 \times 10^{15}$ |
| Magnetic carrier 11 | Magnetic carrier core 2 | ↑ | 10 | CB | PMMA | 1 | $5.9 \times 10^{15}$ |
| Magnetic carrier 12 | Magnetic carrier core 2 | ↑ | 10 | CB | PMMA | 1 | $1.1 \times 10^{15}$ |
| Magnetic carrier 13 | Magnetic carrier core 2 | ↑ | 10 | CB | Alumina | 1 | $1.3 \times 10^{14}$ |

| | | Coating layer | | True specific gravity | D50 | Carrier | Coefficient | |
|---|---|---|---|---|---|---|---|---|
| Carrier name | nm | Kind of resin | (mass %) | (g/cm$^3$) | (μm) | circularity | of variation | Remark |
| Magnetic carrier 1 | — | — | — | 3.4 | 40 | 0.905 | 5.4 | |
| Magnetic carrier 2 | — | — | — | 3.9 | 41 | 0.871 | 7.5 | |
| Magnetic carrier 3 | — | — | — | 3 | 46 | 0.928 | 5.8 | |
| Magnetic carrier 4 | — | — | — | 4.1 | 43 | 0.852 | 9.8 | |
| Magnetic carrier 5 | — | — | — | 3.5 | 45 | 0.948 | 8.7 | |
| Magnetic carrier 6 | | — | — | 3 | 42 | 0.89 | 5.3 | |
| Magnetic carrier 7 | | — | — | 3.2 | 44 | 0.875 | 3.9 | |
| Magnetic carrier 8 | | — | — | 2.6 | 39 | 0.945 | 9.5 | |
| Magnetic carrier 9 | — | — | — | 2.6 | 40 | 0.929 | 7.2 | Coated twice |
| Magnetic carrier 10 | 100 | — | — | 3.3 | 46 | 0.925 | 7 | PMMA was added |
| Magnetic carrier 11 | 20 | — | — | 3.5 | 45 | 0.941 | 7.4 | PMMA was added |
| Magnetic carrier 12 | 400 | — | — | 3.2 | 48 | 0.915 | 9.2 | PMMA was added |
| Magnetic carrier 13 | 200 | — | — | 3.4 | 44 | 0.932 | 7.8 | Alumina was added |

TABLE 2

| | | | | | Added particles 2 | | Volume specific |
|---|---|---|---|---|---|---|---|
| | | Resin layer | | Added particles 1 | | Addition amount | resistivity of each of added particles |
| Carrier name | Core | Kind of resin | (mass %) | Kind | Kind | (mass %) | (Ωcm) |
| Magnetic carrier 14 | Magnetic carrier core 4 | ↑ | 5 | CB | — | — | — |
| Magnetic carrier 15 | Magnetic carrier core 5 | ↑ | 5 | CB | — | — | — |
| Magnetic carrier 16 | Magnetic carrier core 6 | ↑ | 12 | CB | — | — | — |
| Magnetic carrier 17 | Magnetic carrier core 7 | ↑ | 12 | CB | — | — | — |
| Magnetic carrier 18 | Magnetic carrier core 8 | ↑ | 12 | CB | — | — | — |
| Magnetic carrier 19 | Magnetic carrier core 9 | ↑ | 12 | CB | — | — | — |
| Magnetic carrier 20 | Magnetic carrier core 1 | ↑ | 5 | — | — | — | — |
| Magnetic carrier 21 | Magnetic carrier core 1 | ↑ | 5 | CB | — | — | — |
| Magnetic carrier 22 | Magnetic carrier core 1 | ↑ | 5 | CB | Crosslinked melamine | 0.5 | — |

TABLE 2-continued

| Carrier name | Volume average particle diameter of added particles nm | Coating layer Kind of resin | Coating layer (mass %) | True specific gravity (g/cm³) | D50 (μm) | Carrier circularity | Coefficient of variation | Remark |
|---|---|---|---|---|---|---|---|---|
| Magnetic carrier 14 | — | — | — | 2.4 | 41 | 0.91 | 5.6 | |
| Magnetic carrier 15 | — | — | — | 4.3 | 42 | 0.908 | 5.2 | |
| Magnetic carrier 16 | — | — | — | 3.5 | 41 | 0.907 | 0.9 | |
| Magnetic carrier 17 | — | — | — | 3.4 | 40 | 0.91 | 10.5 | |
| Magnetic carrier 18 | — | — | — | 3.5 | 71 | 0.89 | 6.3 | |
| Magnetic carrier 19 | — | — | — | 3.2 | 14 | 0.91 | 6.8 | |
| Magnetic carrier 20 | — | — | — | 3.8 | 40 | 0.873 | 7.3 | |
| Magnetic carrier 21 | — | CHMA-MMA copolymer resin | 3 | 3.4 | 42 | 0.912 | 6.5 | |
| Magnetic carrier 22 | — | Styrene-methacrylate copolymer resin | 3 | 3.5 | 41 | 0.908 | 6.3 | |

<Production Example of Binder Resin for Toner>

(Production Example of Hybrid Resin)

A dropping funnel was loaded with 2.00 mol of styrene, 0.23 mol of 2-ethylhexyl acrylate, 0.15 mol of fumaric acid, and 0.02 mol of a dimer of α-methylstyrene each serving as a monomer for a vinyl copolymer unit, and 0.07 mol of dicumyl peroxide serving as a polymerization initiator. In addition, a 4-l four-necked flask made of glass was loaded with 7.0 mol of polyoxypropylene(2.2)-2,2-bis(4-hydroxyphenyl)propane, 3.0 mol of polyoxyethylene(2.2)-2,2-bis(4-hydroxyphenyl)propane, 3.0 mol of terephthalic acid, 1.5 mol of trimellitic anhydride, 5.0 mol of fumaric acid, and 0.2 g of dibutyltin oxide serving as monomers for a polyester unit. A temperature gauge, a stirring rod, a condenser, and a nitrogen introducing pipe were installed on the four-necked flask, and the flask was placed in a mantle heater. Next, air in the flask was replaced with a nitrogen gas, and then the flask was gradually heated while the mixture in the flask was stirred. Then, the monomers for a vinyl resin, the crosslinking agent, and the polymerization initiator were dropped from the dropping funnel over 4 hours to the flask while the mixture in the flask was stirred at a temperature of 145° C. Next, the temperature of the mixture was heated to 200° C., and then the mixture was subjected to a reaction for 4 hours, whereby a hybrid resin was obtained. The hybrid resin thus obtained had a weight average molecular weight of 16,000, number average molecular weight of 2,200, a glass transition point of a solid content of 56° C.

<Production example of toner>

(Production example 1 of toner (pulverization method))

| | |
|---|---|
| Hybrid resin described above | 100 parts by mass |
| Wax (normal paraffin, highest endothermic peak temperature measured with a differential scanning calorimeter (DSC): 76° C., Mn: 580) | 4 parts by mass |
| Aluminum compound of 1,4-di-t-butylsalicylic acid | 1 part by mass |
| Cyan pigment (Pigment Blue 15:3) | 5 parts by mass |

Preliminary mixing was performed with a Henschel mixer in accordance with the above formulation. The resultant was melted and kneaded with a biaxial extruding kneader at a material temperature of 130° C. After having been cooled, the resultant was coarsely pulverized by using a hammer mill into particles each having a particle diameter of about 1 to 2 mm. Next, the coarse particles were finely pulverized with an air-jet pulverizer into particles each having a particle diameter of 15 μm or less. Further, the resultant finely pulverized products were treated with the apparatus shown in FIG. 1 that could perform classification and a surface modification (spheroidization) treatment using a mechanical impact force at the same time. As a result, toner particles 1 having an average circularity of 0.932 were obtained.

1.0 part by mass of a needle-shape titanium oxide fine powder (subjected to a hydrophobic treatment, primary number average particle diameter: 30 nm, BET=62, treated with 10 mass % of an isobutyl silane coupling agent) and 0.5 part by mass of a hydrophobic treated silica fine powder (BET=80, treated with a dimethylsilicone oil) were externally added to 100 parts by mass of the above toner particles 1 with a Henschel mixer, whereby a toner 1 was obtained.

(Production example 2 of toner (emulsion agglomeration method))

Dispersion liquid A

| | |
|---|---|
| Styrene | 350 parts by mass |
| n-butyl acrylate | 100 parts by mass |
| Acrylic acid | 25 parts by mass |
| t-dodecyl mercaptan | 10 parts by mass |

The above compositions were mixed and dissolved to be prepared as a monomer mixture.

| | |
|---|---|
| Paraffin wax dispersion liquid having a melting point of 78° C. (solid content concentration 30%, dispersed particle diameter 0.14 μm) | 100 parts by mass |

-continued

| | |
|---|---|
| Anionic surfactant (manufactured by DAI-ICHI KOGYO SEIYAKU CO., LTD: NEOGEN SC) | 1.2 parts by mass |
| Nonionic surfactant (manufactured by Sanyo Chemical Industries, Ltd.: NONIPOL 400) | 0.5 part by mass |
| Ion-exchanged water | 1,530 parts by mass |

The above compositions were dispersed in a flask, and heating was started while replacement with nitrogen was performed. When a liquid temperature reached 70° C., a solution prepared by dissolving 6.56 parts by mass of potassium persulfate in 350 parts by mass of ion-exchanged water was charged into the resultant. While the liquid temperature was kept at 70° C., the above monomer mixture was loaded, and the whole was stirred. Then, the liquid temperature was increased to 80° C., and emulsion polymerization was continued for 6 hours as it was. After that, the liquid temperature was reduced to 45° C., and then the resultant was filtered through a filter, whereby a dispersion liquid A was obtained. The polymer particles in the dispersion liquid thus obtained had an average particle diameter of 0.16 μm, a glass transition point of a solid content of 60° C., a weight average molecular weight (Mw) of 16,000, and a peak molecular weight of 11,000. The polymer particle contained 6 mass % of the paraffin wax. The observation of a thin section of the solid content with a transmission electron microscope confirmed that wax particles were included in polymer particles.

| Dispersion liquid B | |
|---|---|
| Styrene | 350 parts by mass |
| n-butyl acrylate | 100 parts by mass |
| Acrylic acid | 25 parts by mass |

The above compositions with the ratio indicated above were mixed and dissolved to be prepared as a monomer mixture.

| | |
|---|---|
| Fischer-Tropsch wax dispersion liquid having a melting point of 105° C. (solid content concentration 30%, dispersed particle diameter 0.15 μm) | 100 parts by mass |
| Anionic surfactant (manufactured by DAI-ICHI KOGYO SEIYAKU CO., LTD: NEOGEN SC) | 1.7 parts by mass |
| Nonionic surfactant (manufactured by Sanyo Chemical Industries, Ltd.: NONIPOL 400) | 0.5 part by mass |
| Ion-exchanged water | 1,530 parts by mass |

The above compositions were dispersed in a flask, and heating was started while replacement with nitrogen was performed. When a liquid temperature reached 65° C., a solution prepared by dissolving 5.80 parts by mass of potassium persulfate in 300 parts of ion-exchanged water was charged into the resultant. While the liquid temperature was kept at 65° C., the above monomer mixture was loaded, and the whole was stirred. Then, the liquid temperature was increased to 75° C., and emulsion polymerization was continued for 8 hours as it was. After that, the liquid temperature was reduced to 40° C., and then the resultant was filtered through a filter, whereby a dispersion liquid B was obtained. The dispersion liquid thus obtained had an average particle diameter of 0.16 μm, a glass transition point of a solid content of 63° C., a weight average molecular weight (Mw) of 700,000. The polymer particle contained 6 mass % of the Fischer-Tropsch wax. The observation of a thin section of the solid content with a transmission electron microscope confirmed that wax particles were included in polymer particles.

| Dispersion liquid C | |
|---|---|
| C.I. Pigment Blue 15:3 | 12 parts by mass |
| Anionic surfactant (manufactured by DAI-ICHI KOGYO SEIYAKU CO., LTD: NEOGEN SC) | 2 parts by mass |
| Ion-exchanged water | 78 parts by mass |

The above materials were mixed, and were dispersed by using a sand grinder mill, whereby a dispersion liquid C was obtained.

300 parts by mass of the dispersion liquid A, 150 parts by mass of the dispersion liquid B, and 25 parts by mass of the dispersion liquid C were loaded into a 1-l separable flask mounted with a stirring device, a cooling pipe, and a temperature gauge, and the whole was stirred. 180 parts by mass of a 10% aqueous solution of sodium chloride were dropped as an agglomerate reagent to the mixed liquid, and the temperature of the mixture in the flask was heated to 54° C. in an oil bath for heating while the mixture was stirred. After the temperature had been held at 48° C. for 1 hour, the resultant was observed with an optical microscope. The observation confirmed that associated particles each having a diameter of about 5 μm were formed.

In the subsequent fusing step, 3 parts by mass of an anionic surfactant (manufactured by DAI-ICHI KOGYO SEIYAKU CO., LTD: NEOGEN SC) were added to the resultant. After that, a flask made of stainless steel was hermetically sealed, the temperature of the mixture was heated to 100° C. while stirring was continued by using a magnetic seal, and the temperature was held for 3 hours. Then, the resultant was cooled. After that, a reaction product was filtered and sufficiently washed with ion-exchanged water. After that, the product was dried, whereby toner particles 2 were obtained. The resultant toner particles 2 had a weight average particle diameter (D4) of 5.4 μm, a peak molecular weight by means of gel permeation chromatography (hereinafter, referred to as "GPC") of 11,000, and an Mw of 200,000.

1.0 part by mass of a needle-like titanium oxide fine powder (BET=62, treated with 10 mass % of an isobutyl silane coupling agent) was externally added to 100 parts by mass of the above toner particles 2 with a Henschel mixer, whereby a toner 2 was obtained.

(Production Example 3 of Toner (Dissolution Suspension Granulation Method))

720 parts by mass of an adduct of bisphenol A with 2 mol of ethylene oxide, 270 parts by mass of isophthalic acid, and 2 parts by mass of dibutyltin oxide were loaded into a reaction tank equipped with a cooling pipe, a stirrer, and a nitrogen introducing pipe, and the whole was subjected to a reaction at normal pressure and 230° C. for 8 hours. The resultant was subjected to a reaction for an additional 5 hours under a reduced pressure of 10 to 15 mmHg. After that, the temperature of the resultant was cooled to 160° C., 31 parts by mass of phthalic anhydride were added to the resultant, and the whole was subjected to a reaction for 2 hours. Next, the temperature of the resultant was cooled to 80° C., and the resultant was allowed to react with 188 parts by mass of isophorone diisocyanate in ethyl acetate for 2 hours, whereby a polyester prepolymer (A) having an isocyanate group was obtained. Next, 270 parts by mass of the prepolymer (A) and 15 parts by mass of isophorone diamine were allowed to react with each other at 50° C. for 2 hours, whereby a urea-denatured polyester resin (i) having a weight average molecular weight of 65,000 was obtained. In the same manner as in the foregoing, 724 parts by mass of an adduct of bisphenol A with 2 mol of ethylene oxide and 276 parts by mass of terephthalic acid were subjected to condensation polymerization at normal pressure and 230° C. for 8 hours. Next, the resultant was subjected to a reaction for 5 hours under a reduced pressure of 10 to 15 mmHg, whereby a non-denatured polyester (a) having a peak molecular weight of 5,000 was obtained. 200 parts by mass of the urea-denatured polyester resin (i) and 800 parts by mass of the non-denatured polyester (a) were dissolved in and mixed with 2,000 parts by mass of a mixed solvent of ethyl acetate and methyl ethyl ketone (MEK) (at a ratio of 1:1), whereby a solution of a toner binder (1) in ethyl acetate and MEK was obtained. Part of the solution was dried under reduced pressure, whereby the toner binder (1) was isolated. The Tg of the isolated binder (1) was 58° C.

240 parts by mass of the solution of the toner binder (1) in ethyl acetate and MEK, 20 parts by mass of pentaerythritol tetrabehenate (melting point 81° C., melting viscosity 25 mpa·s), and 6 parts by mass of a pigment of C.I. Pigment Blue 15:3 were loaded into a beaker, and the whole was stirred at 60° C. with a TK homo mixer (manufacturer: Tokushu Kika Kogyo) at 12,000 rpm to be uniformly dissolved and dispersed. 706 parts by mass of ion-exchanged water, 294 parts by mass of a 10% suspension of hydroxyapatite (Supatite 10 manufactured by Nippon Chemical Industries CO., LTD.), and 0.2 part by mass of sodium dodecylbenzenesulfonate were loaded into another beaker and uniformly dissolved. Next, the temperature of the resultant was increased to 60° C., the above toner material solution was charged while the resultant was stirred with a TK homo mixer (manufacturer: Tokushu Kika Kogyo) at 12,000 rpm, and the mixture was stirred for 10 minutes. Next, the mixed liquid was transferred to a kolven equipped with a stirring rod and a temperature gauge, and the temperature of the resultant was heated to 98° C. in such a manner that the solvent would be removed. Then, the remainder was filtered out, washed, dried, and subjected to air classification, whereby toner particles 3 were obtained. The toner particles 3 had a weight average particle diameter (D4) of 5.9 μm. 1.0 part by mass of a needle-like titanium oxide fine powder (BET=62, treated with 10 mass % of an isobutyl silane coupling agent) was externally added to 100 parts by mass of the above toner particles 3 with a Henschel mixer, whereby a toner 3 was obtained.

EXAMPLE 1

7.0 parts by mass of the toner 1 were added to 93.0 parts by mass of the magnetic carrier 1, and the whole was mixed with a turbler mixer, whereby a developer 1 was obtained. Meanwhile, 7.0 parts by mass of the toner 1 were added to 1.0 part by mass of the magnetic carrier 1, and the whole was mixed with a turbler mixer, whereby a developer 1 for replenishment was obtained.

The resultant developer 1 and the resultant developer 1 for replenishment were each contained in a container for storing a developer and a container for storing a developer for replenishment of a black station of a commercially available iRC 3100 (manufactured by Canon Inc.), and each were subjected to image output evaluation in a monochromatic mode by using a black station, while development contrast was adjusted in such a manner that an initial image density in each environment would be 1.40. It should be noted that the main body of the iRC 3100 had no drum heater.

An evaluation method is as described below. First, a 50,000-sheet duration test was performed by using A4 paper (color laser copy paper (80 g/m$^2$) of Canon Marketing Japan) and an original manuscript having an image area of 5% under a normal-temperature, low-humidity environment (23° C./5% RH). After that, an evaluation machine was moved to a high-temperature, high-humidity environment (30.0° C./80% RH), and a 50,000-sheet duration test was performed by using A4 paper and an original manuscript having an image area of 20%. After the completion of the duration test, the paper was left for 3 days in the same environment, and then chargeability and fog were confirmed. In addition, the evaluation machine was fixed at a normal-temperature, normal-humidity environment (23° C./60% RH), and a 100,000-sheet duration test was similarly performed by using A4 paper and an original manuscript having an image area of 5%. Measurement conditions and evaluation criteria for each environment are shown below. In addition, Table 3 shows the results of the evaluation of the developer and the developer for replenishment.

(Evaluation for Image Density Stability)

Evaluation for image density stability was performed on the basis of a difference between an image density at an initial stage of duration and an image density after the duration. The image density was measured with a color reflection densitometer (X-RITE 404A: manufactured by X-Rite Co.). After copying operation using solid portion (image density=1.40) as an initial image, the measurement is performed on each 5 sites of the image at an initial stage of duration and upon completion of the duration. Evaluation is performed based on the difference (Δ) between the average of the measurement of 5 sites at an initial stage of duration and the average of the measurement of 5 sites upon completion of the duration. The average of the image at an initial stage of duration was taken as a reference value of the evaluation.

<Evaluation Criteria>

A: Very good (Δ is less than 0.08%)
B: Good (0.08≦Δ<0.15%)
C: Normal (0.15≦Δ<0.20%)
D: Bad (Δ is 0.2% or more)

(Evaluation for Half Tone Reproducibility)

Evaluation for half tone reproducibility was performed on the basis of a difference between a half tone image density at an initial stage of duration and a half tone image density after the duration. The half tone image density was measured with a color reflection densitometer (X-RITE 404A: manufactured by X-Rite Co.). After copying operation using half tone image (image density=0.40) as an initial image, the measurement is performed on each 5 sites of the image at an initial stage of duration and upon completion of the duration. Evaluation is performed based on the difference (Δ) between the average of the measurement of 5 sites at an initial stage of duration and the average of the measurement of 5 sites upon completion of the duration. The average of the image at an initial stage of duration was taken as a reference value of the evaluation.

<Evaluation Criteria>

A: Very good (Δ is less than 0.03)
B: Good (0.03≦Δ<0.05%)
C: Normal (0.05≦Δ<0.08%)
D: Bad (Δ is 0.08% or more)

(Evaluation for Charge Amount)

A method for evaluation for charge amount involved the use of the device shown in FIG. 8 and judgement on the basis of a difference (Δ) between a charge amount at an initial stage of duration and a charge amount upon completion of the duration in each environment. The average charge amount at an initial stage was used as a benchmark for calculating the difference (Δ). Further, the average of the image at an initial stage of duration was taken as a reference value of the evaluation.

<Evaluation Criteria>

A: Very good (Δ is less than 3.0)
B: Good (3.0≦Δ<5.0%)
C: Normal (5.0≦Δ<7.0%)
D: Bad (Δ is 7.0% or more)

(Evaluation for Fog)

Evaluation for fog involved: measuring the whiteness of a white portion with a reflectometer (densitometer TC6MC: Tokyo Denshoku Gijutsu Center Co.); and calculating a fog density (%) from a difference between the whiteness and the average value of the whitenesses of transfer paper. Evaluation criteria are as shown below.

<Evaluation Criteria>

A: Very good (less than 1.2%)
B: Good (1.2% or more to less than 2.4%)
C: Normal (2.4% or more to less than 3.6%)
D: Bad (3.6% or more)

(Evaluation for Carrier Adhesion)

Development contrast was adjusted by using an iRC 3200 (manufactured by Canon Inc.) in such a manner that a toner development amount on a drum would be 0.3 mg/cm$^2$. Then, full-page solid half tone images were continuously outputted on 10 sheets of A4 paper under a normal-temperature, low-humidity (23° C./5% RH) environment. The number of white voids each having a diameter close to a carrier particle diameter in this case was counted at 5th and 10th sheets, and evaluation was performed on the basis of an average number of white voids per sheet of A4 paper.

<White Void Rank>

A: No white voids occur.
B: The average number of white voids is 1 or less.
C: The average number of white voids is more than 1 and 2 or less.
D: The average number of white voids is more than 2 and 5 or less.
E: The average number of white voids is 5 or more.

(Evaluation for Stability of Carrier Concentration in Container for Developer for Replenishment)

5 g of a developer for replenishment were collected from a replenishment port of a container for storing the developer for replenishment every time 1,000 sheets were outputted, and a carrier concentration in the developer for replenishment was measured. A carrier concentration change can be determined from the following equation:

Carrier concentration change (%)=(|(carrier concentration in developer for replenishment upon initial adjustment)−(carrier concentration discharged from container for developer for replenishment)|/carrier concentration in developer for replenishment upon initial adjustment) ×100.

<Evaluation Criteria>

A: The carrier concentration change transition is less than 10%.
B: The carrier concentration change transition is from 10% to less than 20%.
C: The carrier concentration change transition is from 20% to less than 30%.
D: The carrier concentration change transition is 30% or more.

EXAMPLES 2 to 13

The evaluation of each of the developers and developers for replenishment of Examples 2 to 13 was performed in the same manner as in Example 1 except that a magnetic carrier for use in each of the developers and the developers for replenishment was changed. Table 3 shows the results of the evaluation of the developers and the developers for replenishment used in Examples 2 to 13.

EXAMPLES 14 and 15

The evaluation of each of the developers and developers for replenishment of Examples 14 and 15 was performed in the same manner as in Example 13 except that toner for use in each of the developers and the developers for replenishment was changed. Tables 3 and 4 show the results of the evaluation of the developers and the developers for replenishment used in Examples 14 and 15.

EXAMPLES 16 and 17

The evaluation of each of the developers and developers for replenishment of Examples 16 and 17 was performed in the same manner as in Example 1 except that the addition amount of the toner with respect to 1.0 part by mass of the magnetic carrier 1 upon production of a developer for replenishment was changed. Table 4 shows the results of the evaluation of the developers and the developers for replenishment used in Examples 16 and 17.

COMPARATIVE EXAMPLES 1 to 6

The evaluation of each of the developers and developers for replenishment of Comparative Examples 1 to 6 was performed in the same manner as in Example 1 except that a magnetic carrier for use in each of the developers and the developers for replenishment was changed. Table 4 shows the results of the evaluation of the developers and the developers for replenishment used in Comparative Examples 1 to 6.

COMPARATIVE EXAMPLES 7 and 8

The evaluation of each of the developers and developers for replenishment of Comparative Examples 7 and 8 was performed in the same manner as in Example 1 except that the addition amount of the toner with respect to 1.0 part by mass of the magnetic carrier 1 upon production of a developer for replenishment was changed. Table 4 shows the results of the evaluation of the developers and the developers for replenishment used in Comparative Examples 7 and 8.

EXAMPLES 18 to 20

The evaluation of each of the developers and developers for replenishment of Examples 18 to 20 was performed in the same manner as in Example 1 except that a magnetic carrier for use in each of the developers and the developers for replenishment was changed. Table 4 shows the results of the evaluation of the developers and the developers for replenishment used in Examples 18 to 20.

TABLE 3

| | Developer name | Toner name | Carrier name | Number of parts by mass of toner with respect to 1 part of carrier in replenisher | Durability at normal temperature and normal humidity 0 to 100k: Image density stability (Density) | Charging stability: Judge-ment | Charging stability: Initial charge amount (variation in charge amount) | Halftone reproducibility (Density) | Fog upon completion of duration (%) |
|---|---|---|---|---|---|---|---|---|---|
| Example 1 | Developer 1 | Toner 1 | Magnetic carrier 1 | 7 | A | A | −22.4 (1.4) | A | A (0.5) |
| Example 2 | Developer 2 | Toner 1 | Magnetic carrier 2 | 7 | A | A | −21.2 (2.6) | A | A (0.6) |
| Example 3 | Developer 3 | Toner 1 | Magnetic carrier 3 | 7 | A | A | −34.5 (2.4) | A | A (0.7) |
| Example 4 | Developer 4 | Toner 1 | Magnetic carrier 4 | 7 | A | B | −21.2 (3.6) | A | A (0.8) |
| Example 5 | Developer 5 | Toner 1 | Magnetic carrier 5 | 7 | A | B | −22.1 (4.1) | A | A (0.7) |
| Example 6 | Developer 6 | Toner 1 | Magnetic carrier 6 | 7 | A | A | −25.2 (1.5) | A | A (0.5) |
| Example 7 | Developer 7 | Toner 1 | Magnetic carrier 7 | 7 | A | B | −26.6 (3.7) | A | B (1.5) |
| Example 8 | Developer 8 | Toner 1 | Magnetic carrier 8 | 7 | A | C | −35.7 (6.2) | A | A (1.1) |
| Example 9 | Developer 9 | Toner 1 | Magnetic carrier 9 | 7 | A | B | −33.5 (4.8) | A | A (1.0) |
| Example 10 | Developer 10 | Toner 1 | Magnetic carrier 10 | 7 | A | A | −25.2 (2.1) | A | A (0.8) |
| Example 11 | Developer 11 | Toner 1 | Magnetic carrier 11 | 7 | A | A | −24.1 (2.5) | A | A (0.6) |
| Example 12 | Developer 12 | Toner 1 | Magnetic carrier 12 | 7 | A | A | −24.1 (1.9) | A | A (1.1) |
| Example 13 | Developer 13 | Toner 1 | Magnetic carrier 13 | 7 | A | A | −23.2 (2.0) | A | A (0.7) |
| Example 14 | Developer 14 | Toner 2 | Magnetic carrier 13 | 7 | A | A | −23.4 (1.6) | A | A (1.1) |

| | Durability at normal temperature and low humidity 0 to 50k: Image density stability (variation in density) | Charging stability: Judgement | Charging stability: Initial charge amount (variation in charge amount) | Durability at high temperature and high humidity 50 to 100k: Image density stability (variation in density) | Charging stability: Judgement | Charging stability: Initial charge amount (variation in charge amount) | Fog after leaving for 3 days (%) |
|---|---|---|---|---|---|---|---|
| Example 1 | A | A | −29.2 (1.6) | A | A | −16.5 (1.2) | A (0.8) |
| Example 2 | A | B | −27.2 (3.6) | A | B | −13.2 (3.2) | B (1.5) |
| Example 3 | A | A | −42.5 (2.1) | A | B | −24.5 (3.6) | B (1.9) |
| Example 4 | A | A | −27.2 (2.1) | B | C | −13.5 (5.2) | C (2.7) |
| Example 5 | A | A | −27.1 (2.6) | A | B | −14.0 (4.8) | C (2.9) |
| Example 6 | A | A | −33.1 (1.5) | A | A | −24.1 (1.3) | A (0.6) |
| Example 7 | A | A | −35.2 (3.1) | A | B | −19.7 (3.4) | B (1.9) |
| Example 8 | A | A | −45.5 (2.1) | A | C | −23.5 (5.5) | C (2.6) |
| Example 9 | A | A | −42.5 (2.6) | A | B | −23.3 (4.5) | B (2.0) |
| Example 10 | A | A | −27.8 (2.3) | A | A | −17.3 (2.9) | B (1.7) |
| Example 11 | A | A | −28.1 (2.5) | A | B | −19.6 (3.6) | B (1.8) |
| Example 12 | A | A | −27.0 (2.6) | A | B | −20.0 (4.8) | C (3.2) |
| Example 13 | A | A | −29.1 (2.2) | A | B | −14.0 (3.9) | B (2.1) |
| Example 14 | A | A | −32.1 (1.9) | A | B | −16.2 (4.8) | B (1.6) |

| | Carrier adhesion at 5th sheet | Carrier adhesion at 10th sheet | Stability of carrier concentration in container for developer for replenishment (%) |
|---|---|---|---|
| Example 1 | A | B | A (5) |
| Example 2 | A | B | B (12) |
| Example 3 | A | B | A (7) |
| Example 4 | C | C | C (24) |
| Example 5 | B | C | A (7) |
| Example 6 | A | A | A (5) |
| Example 7 | A | A | B (13) |
| Example 8 | C | C | B (18) |
| Example 9 | C | C | B (16) |
| Example 10 | B | C | A (8) |
| Example 11 | B | C | A (7) |
| Example 12 | B | C | A (4) |

TABLE 3-continued

| | | | |
|---|---|---|---|
| Example 13 | B | C | A (6) |
| Example 14 | A | B | A (5) |

TABLE 4

| | | | | | Durability at normal temperature and normal humidity 0 to 100k | | | | |
|---|---|---|---|---|---|---|---|---|---|
| | | | | Number of parts by | | Charging stability | | | |
| | Developer name | Toner name | Carrier name | mass of toner with respect to 1 part of carrier in replenisher | Image density stability (density) | Judge-ment | Initial charge amount (variation in charge amount) | Half tone reproducibility (Density) | Fog upon completion of duration (%) |
| Example 15 | Developer 15 | Toner 3 | Magnetic carrier 13 | 7 | A | A | −25.4 (1.4) | A | A (0.9) |
| Example 16 | Developer 1 | Toner 1 | Magnetic carrier 1 | 2 | C | C | −27.4 (6.6) | A | C (2.9) |
| Example 17 | Developer 1 | Toner 1 | Magnetic carrier 1 | 50 | B | C | −28.1 (5.8) | A | A (0.8) |
| Comparative Example 1 | Developer 16 | Toner 1 | Magnetic carrier 14 | 7 | A | A | −24.1 (1.9) | A | A (0.7) |
| Comparative Example 2 | Developer 17 | Toner 1 | Magnetic carrier 15 | 7 | A | A | −21.2 (2.6) | A | A (0.6) |
| Comparative Example 3 | Developer 18 | Toner 1 | Magnetic carrier 16 | 7 | A | A | −21.2 (2.7) | A | D (3.8) |
| Comparative Example 4 | Developer 19 | Toner 1 | Magnetic carrier 17 | 7 | A | A | −24.5 (1.8) | A | A (0.8) |
| Comparative Example 5 | Developer 20 | Toner 1 | Magnetic carrier 18 | 7 | A | A | −24.1 (1.9) | D | A (0.7) |
| Comparative Example 6 | Developer 21 | Toner 1 | Magnetic carrier 19 | 7 | A | A | −26.1 (1.1) | A | A (0.4) |
| Comparative Example 7 | Developer 1 | Toner 1 | Magnetic carrier 1 | 1 | D | D | −29.4 (7.2) | A | D (3.9) |
| Comparative Example 8 | Developer 1 | Toner 1 | Magnetic carrier 1 | 51 | B | D | −28.4 (7.1) | A | A (1.0) |
| Example 18 | Developer 22 | Toner 1 | Magnetic carrier 20 | 7 | A | A | −28.0 (2.9) | A | A (0.8) |
| Example 19 | Developer 23 | Toner 1 | Magnetic carrier 21 | 7 | A | A | −24.2 (3.7) | A | A (0.6) |
| Example 20 | Developer 24 | Toner 1 | Magnetic carrier 22 | 7 | A | A | −26.2 (3.8) | A | A (0.5) |

| | Durability at normal temperature and low humidity 0 to 50k | | | Durability at high temperature and high humidity 50 to 100k | | | |
|---|---|---|---|---|---|---|---|
| | Image density | Charging stability | | Image density | Charging stability | | |
| | stability (variation in density) | Judgement | Initial charge amount (variation in charge amount) | stability (variation in density) | Judgement | Initial charge amount (variation in charge amount) | Fog after leaving for 3 days (%) |
| Example 15 | A | B | −41.3 (3.2) | A | A | −17.5 (1.8) | A (1.0) |
| Example 16 | A | B | −30.1 (3.9) | A | C | −16.9 (5.1) | C (2.8) |
| Example 17 | A | B | −32.3 (4.2) | B | C | −21.5 (5.8) | A (1.0) |
| Comparative Example 1 | Unable to evaluate owing to the occurrence of carrier adhesion | | | — | — | — | — |
| Comparative Example 2 | A | A | −29.1 (2.2) | Unable to evaluate owing to the occurrence of the packing of a developer | | | |
| Comparative Example 3 | A | A | −30.1 (2.3) | A | A | −16.5 (1.6) | D (5.9) |
| Comparative Example 4 | A | A | −29.2 (2.6) | A | A | −19.5 (1.4) | A (0.7) |
| Comparative Example 5 | A | A | −28.1 (2.5) | A | A | −17.5 (1.8) | A (1.1) |
| Comparative Example 6 | A | A | −27.8 (2.3) | A | A | −16.2 (2.2) | A (0.9) |
| Comparative Example 7 | A | B | −33.1 (4.3) | A | D | −17.9 (7.1) | D (6.3) |
| Comparative Example 8 | A | B | −32.3 (4.7) | A | D | −23.2 (7.6) | A (0.9) |
| Example 18 | B | C | −37.1 (6.9) | A | B | −18.2 (5.2) | B (1.3) |
| Example 19 | A | B | −30.2 (3.5) | A | B | −15.1 (3.3) | B (1.6) |
| Example 20 | A | B | −29.8 (4.8) | A | B | −17.2 (3.4) | B (1.7) |

TABLE 4-continued

| | Carrier adhesion at 5th sheet | Carrier adhesion at 10th sheet | Stability of carrier concentration in container for developer for replenishment (%) |
|---|---|---|---|
| Example 15 | B | A | A (7) |
| Example 16 | B | A | B (17) |
| Example 17 | B | A | C (26) |
| Comparative Example 1 | D | D | C (27) |
| Comparative Example 2 | B | A | D (32) |
| Comparative Example 3 | B | A | C (23) |
| Comparative Example 4 | D | D | C (26) |
| Comparative Example 5 | B | A | D (34) |
| Comparative Example 6 | D | D | D (39) |
| Comparative Example 7 | B | A | B (18) |
| Comparative Example 8 | B | A | D (39) |
| Example 18 | B | A | B (12) |
| Example 19 | B | A | B (13) |
| Example 20 | B | A | C (21) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A developer for replenishment comprising at least:

a toner; and a magnetic carrier, wherein:

1 part by mass of the magnetic carrier is blended with 2 to 50 parts by mass of the toner; and the magnetic carrier (i) contains a ferrite core which has a porous structure, and a resin component, (ii) has a true specific gravity of 2.5 to 4.2 g/cm$^3$, (iii) has a 50% particle diameter on a volume basis (D50) of 15 to 70 μm, and (iv) has an average circularity of 0.850 to 0.950, the average circularity having a coefficient of variation of 1.0 to 10.0%.

2. A developer for replenishment according to claim 1, wherein fine particles are dispersed in the resin component, and the fine particles have a primary number average particle diameter of 10 to 500 nm.

3. A developer for replenishment according to claim 2, wherein the fine particles have a volume specific resistivity of $10^{12}$ Ω·cm or more.

4. A developer for replenishment according to claim 2 or 3, wherein the fine particles comprise crosslinked resin fine particles.

5. A developer for replenishment according to any one of claims 1 to 3, wherein a content of the resin component is 5 to 25 mass % with respect to a mass of the ferrite core.

6. An image forming method employing a two component development method comprising at least:

performing development;

replenishing a developer for replenishment to a developing unit; and discharging at least an excessive magnetic carrier in the developing unit from the developing unit, wherein:

the developer for replenishment comprises at least a toner and a magnetic carrier, and in the developer for replenishment, 1 part by mass of the magnetic carrier is blended with 2 to 50 parts by mass of the toner; and the magnetic carrier (i) contains a ferrite core which has a porous structure, and a resin component, (ii) has a true specific gravity of 2.5 to 4.2 g/cm$^3$, (iii) has a 50% particle diameter on a volume basis (D50) of 15 to 70 μm, and (iv) has an average circularity of 0.850 to 0.950, the average circularity having a coefficient of variation of 1.0 to 10.0%.

* * * * *